US008568340B2

(12) United States Patent
Endo

(10) Patent No.: US 8,568,340 B2
(45) Date of Patent: Oct. 29, 2013

(54) WALKING MOTION ASSISTING DEVICE

(75) Inventor: Yosuke Endo, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 322 days.

(21) Appl. No.: 13/086,859

(22) Filed: Apr. 14, 2011

(65) Prior Publication Data

US 2011/0264015 A1 Oct. 27, 2011

(30) Foreign Application Priority Data

Apr. 23, 2010 (JP) ..... 2010-100267

(51) Int. Cl.
*A61H 1/00* (2006.01)
*A61H 1/02* (2006.01)
*A61H 5/00* (2006.01)

(52) U.S. Cl.
USPC ..... 601/5; 601/35

(58) Field of Classification Search
USPC ..... 601/5, 33–35; 602/16, 23–25; 623/25, 623/30; 600/595; 331/65
See application file for complete search history.

(56) References Cited

U.S. PATENT DOCUMENTS 6,821,233 B1 * 11/2004 Colombo et al. ..... 482/54
7,041,069 B2 * 5/2006 West ..... 601/5
7,190,141 B1 * 3/2007 Ashrafiuon et al. ..... 318/568.12
7,252,644 B2 * 8/2007 Dewald et al. ..... 601/5
7,433,733 B2 * 10/2008 Endo et al. ..... 600/546
7,860,562 B2 * 12/2010 Endo et al. ..... 600/546
8,034,055 B2 * 10/2011 Cragg ..... 606/86 R
8,048,008 B2 * 11/2011 Yasuhara et al. ..... 601/35
8,177,733 B2 * 5/2012 Ashihara et al. ..... 601/35
8,248,737 B2 * 8/2012 Chen et al. ..... 360/313
8,317,732 B2 * 11/2012 Yasuhara et al. ..... 601/5

FOREIGN PATENT DOCUMENTS

JP 2007-275282 10/2007
JP 2007-275283 10/2007

* cited by examiner

*Primary Examiner* — Kristen Matter
(74) *Attorney, Agent, or Firm* — Rankin, Hill & Clark LLP

(57) ABSTRACT

Provided is a walking motion assisting device capable of assisting a leg of an agent in walking motion to alleviate an assisting burden or eliminate an assisting necessity by a caregiver. According to the walking motion assisting device (1), the value of a persistent energy input term ($\zeta_0$) contained in a simultaneous differential equation denoting a second model configured to generate a second motion oscillator ($\phi_1$) is adjusted so as to limit a landing position (x) of a leg of the agent in a specified range $[x_1, x_2]$. Further, the motion state of the leg is recognized on the basis of a variation mode of a second oscillator ($\xi_2$), and on the basis of the recognition result, the relative motion between the thigh and crus of the leg around the knee joint is assisted.

13 Claims, 8 Drawing Sheets

MID-MOTION (POST-PHASE OF STANDING LEG)

FIRST MOTION STATE (FLOATING LEG)

FRONTAL PLANE
FIRST MOTION STATE (FLOATING LEG)

FRONTAL PLANE
FIRST MOTION STATE TO SECOND MOTION STATE (POST-PHASE OF FLOATING LEG)

SECOND PRE-MOTION STATE (PRE-PHASE OF STANDING LEG)

SECOND POST-MOTION STATE (MID-PHASE OF STANDING LEG TO POST-PHASE OF STANDING LEG)

WALKING MOTION ASSISTING DEVICE

BACKGROUND OF THE INVENTION

1. Field of the Invention

The present invention relates to a walking motion assisting device which applies a force from an actuator to a leg of an agent through an orthosis mounted on the leg to assist the leg in walking motion.

2. Description of the Related Art

There has been proposed a technical approach to perform a walking training for an agent on a treadmill by assisting the motions of a leg of the agent through a walking motion assisting device mounted on the leg thereof (refer to U.S. Pat. No. 6,821,233, Japan Patent No. 4185108, and Japanese Patent Laid-open No. 2007-275283).

However, sometimes in the walking training the agent cannot lift a leg to step forward, and consequently the leg is left on the belt of the treadmill and will be moved backward. In this case, it is quite often that a caregiver has to help the agent in lifting the leg thereof so as to step forward or motions like that, which causes great burden to the caregiver.

SUMMARY OF THE INVENTION

The present invention has been accomplished in view of the aforementioned problems, and it is therefore an object of the present invention to provide a walking motion assisting device capable of assisting a leg of an agent in walking motion to alleviate assisting burden or eliminate assisting necessity by a caregiver.

The walking motion assisting device of the present invention comprises: a first orthosis mounted on a body of an agent; a second orthosis mounted on a thigh thereof; a third orthosis mounted on a crus thereof; a first actuator; a second actuator; and a controller configured to control the amplitude and the phase of an output from the first actuator and the amplitude and the phase of an output from the second actuator, respectively. The walking motion assisting device of the present invention is configured to assist walking motion of the agent by assisting a relative motion between the body and the thigh of the agent around a hip joint through the first orthosis and the second orthosis according to the output from the first actuator and a relative motion between the thigh and the crus of the agent around a knee joint through the second orthosis and the third orthosis according to the output from the second actuator.

To attain an object described above, the controller of the walking motion assisting device according to the present invention is provided with a motion oscillator detecting element configured to detect an oscillation signal varying with time according to periodical motions of a leg of the agent as a second motion oscillator; a second oscillator generating element configured to generate a second oscillator as an output oscillation signal from a second model, which is defined by a simultaneous differential equation of state variables denoting a motion state of the agent and generates the output oscillation signal varying with time at a specific angular velocity defined on the basis of a second intrinsic angular velocity and an amplitude corresponding to a value of a persistent energy input term included in the simultaneous differential equation according to an input oscillation signal, by inputting the second motion oscillator determined by the motion oscillator detecting element as the input oscillation signal to the second model; a first control command signal generating element configured to generate a first control command signal for the first actuator according to the second oscillator generated by the second oscillator generating element; a first state monitoring element configured to calculate a landing position of a leg with respect to the frontal plane on the basis of a determined hip joint angle, a determined knee joint angle, the thigh length and the crus length of the agent according to a geometrical relationship; an energy adjusting element configured to adjust the value of the persistent energy input term so as to limit the landing position of the leg calculated by the first state monitoring element in a specified range; a second state monitoring element configured to recognize the motion state of a leg of the agent according to a variation mode of the second motion oscillator detected by the motion oscillator detecting element or a variation mode of the second oscillator generated by the second oscillator generating element; and a second control command signal generating element configured to generate a second control command signal for the second actuator according to the leg motion state of the agent recognized by the second state monitoring element to assist the relative motion between the thigh and the crus of the agent around the knee joint in different modes (First aspect).

According to the walking motion assisting device of the present invention, an oscillation signal varying with time according to motions of a leg of the agent is detected as a second motion oscillator. The second motion oscillator is input into the second model to generate the second oscillator. A control command signal is generated on the basis of the second oscillator, and the first actuator is controlled according to the control command signal.

According thereto, the force for assisting the leg motion of the agent can be controlled with the motion period or the phase variation velocity of the leg of the agent in harmony with the motion period or the phase variation rate of the first actuator.

The value of the persistent energy input term contained in the simultaneous differential equation denoting the second model is adjusted so as to limit the landing position of the leg with respect to the frontal plane of the agent (the foot position of the leg when the leg transits from the leg floating state to the leg standing state) in the specified range.

According thereto, the force for assisting the thigh motion by the first actuator is adjusted. For example, when the previous time's landing position of the leg is behind the specified range, the value of the persistent energy input term is increased to reinforce the force for assisting the thigh motion so as to make the current time's landing position of the leg forward than the previous time's landing position. On the other hand, when the previous time's landing position of the leg is in front of the specified range, the value of the persistent energy input term is decreased to weaken the force for assisting the thigh motion so as to make the current time's landing position of the leg behind the previous time's landing position. Thereby, the burden by a caregiver for assisting the thigh of the agent in walking motion can be alleviated or eliminated.

Further, the motion state of the leg is recognized on the basis of the variation mode of the second motion oscillator or the second oscillator. On the basis of the recognition result, the relative motion between the thigh and crus of the leg around the knee joint is assisted.

According thereto, in the walking motion of the agent, the motion between the thigh and the crus around the knee joint can be assisted appropriately in view of the motion state of the leg of the agent. Thereby, the burden by a caregiver for assisting the crus of the agent in walking motion can be alleviated or eliminated.

It should be noted that one motion state estimated as a motion state of a leg of a normal subject in view of the variation mode of the second motion oscillator or the second oscillator has been recognized as the motion state of the leg of the agent. In other words, even if the leg of the agent has been recognized as being in a specific motion state, it is not limited that the actual motion state thereof is in the specific motion state.

In the walking motion assisting device of the first aspect of the present invention, it is acceptable that the second state monitoring element is configured to recognize a second motion state in which the thigh of a leg is moved backward in a post-phase of a leg floating state and a leg standing state of the leg as the leg motion state of the agent; and the second control command signal generating element is configured to generate the second control command signal for the second actuator when the leg of the agent has been recognized as being in the second motion state by the second state monitoring element so as to assist the relative motion between the thigh and the crus of the agent around the knee joint in the direction of stretching the knee (Second aspect).

According to the walking motion assisting device having the aforementioned configuration, when the leg of the agent has been recognized as being in the second motion state (in which the thigh of the leg is moved backward in a post-phase of a leg floating state and a leg standing state), the relative motion between the thigh and the crus around the knee joint in the direction of stretching the knee is assisted.

According thereto, it is possible to avoid the situation where it is difficult for a leg to step on the floor or the balance of the body of the agent is lost when the leg steps on the floor due to insufficient stretch of the knee even though the thigh has been shaken backward. Thereby, the burden by a caregiver for assisting the agent in walking motion to prevent such situation can be alleviated or eliminated.

In the walking motion assisting device of the second aspect, it is acceptable that the second state monitoring element is configured to recognize separately a second pre-motion state in which the thigh is ahead of the frontal plane and a second post-motion state in which the thigh is behind the frontal plane as the second motion state; and the second control command signal generating element is configured to generate the second control command signal for the second actuator when the leg of the agent has been recognized as being in the second post-motion state by the second state monitoring element so as to assist the relative motion between the thigh and the crus of the agent around the knee joint in the direction of stretching the knee with a stronger force than the case when the leg of the agent has been recognized as being in the second pre-motion state by the second state monitoring element (Third aspect).

According to the walking motion assisting device having the aforementioned configuration, when the leg of the agent has been recognized as being in the second post-motion state (in which the leg is behind the frontal plane in the second motion state), the force for assisting the relative motion between the thigh and the crus of the leg around the knee joint in the direction of stretching the knee is increased stronger than the case when the leg of the agent has been recognized as being in the second pre-motion state (in which the leg is in the second motion state and the thigh is ahead of the frontal plane).

According thereto, it is possible to avoid the situation where a leg is difficult to step on the floor or the balance of the agent's body is lost when the leg steps on the floor due to insufficient stretch of the knee even though the thigh has been shaken ahead of the frontal plane. Thereby, the burden by a caregiver for assisting the agent in walking motion to prevent such situation can be alleviated or eliminated.

In the walking motion assisting device of the third aspect, it is acceptable that the second control command signal generating element is configured to generate the second control command signal for the second actuator when the leg of the agent has been recognized as being in the second post-motion state by the second state monitoring element so as to increase continuously or intermittently the force for assisting the relative motion between the thigh and the crus of the agent around the knee joint in the direction of stretching the knee at least in the initial phase of the second post-motion state (Fourth aspect).

According to the walking motion assisting device having the aforementioned configuration, when the leg of the agent has been recognized as being in the second post-motion state, the force for assisting the relative motion between the thigh and the crus of the agent around the knee joint in the direction of stretching the knee is increased continuously or intermittently at least in the initial phase of the second post-motion state.

According thereto, it is possible to avoid the situation where the force for assisting knee to stretch when the leg is moved ahead of the frontal plane varies abruptly, and consequently, the motion of the leg of the agent becomes discontinuously due to the abrupt force variation, which makes it difficult for the agent to land the leg on the floor or makes the agent lose the balance of the body when landing the leg on the floor. Thereby, the burden by a caregiver for assisting the agent in walking motion to prevent such situation can be alleviated or eliminated.

In the walking motion assisting device of the second aspect, it is acceptable that the first control command signal generating element is configured to generate the first control command signal for the first actuator when the leg of the agent has been recognized as being in the second motion state by the second state monitoring element so as to decrease the force for assisting the relative motion between the body and the thigh of the agent around the hip joint according to an angular velocity of the hip joint at least in the initial phase of the second motion state (Fifth aspect).

According to the walking motion assisting device having the aforementioned configuration, the force for assisting the relative motion between the body and the thigh of the agent around the hip joint is attenuated according to an angular velocity of the hip joint at least in the initial phase of the second motion state (particularly when the leg is still in the leg floating state). According thereto, the floor reaction force can be prevented from becoming excessively stronger when the leg in the second motion state lands on the floor, and consequently to prevent the agent from losing balance due to the floor reaction force. Thereby, the burden by a caregiver for assisting the agent in walking motion to prevent such situation can be alleviated or eliminated.

In the walking motion assisting device of the second aspect, it is acceptable that the second control command signal generating element is configured to generate the second control command signal for the second actuator when the leg of the agent has been recognized as being in the second motion state by the second state monitoring element so as to decrease the force for assisting the relative motion between the thigh and the crus of the agent around the knee joint in the direction of stretching the knee according to an angular velocity of the knee joint at least in the initial phase of the second motion state (Sixth aspect).

According to the walking motion assisting device having the aforementioned configuration, the force for assisting the relative motion between the thigh and the crus of the agent around the knee joint in the direction of stretching the knee is attenuated according to an angular velocity of the knee joint at least in the initial phase of the second motion state (particularly when the leg is still in the leg floating state). According thereto, the floor reaction force can be prevented from becoming excessively stronger when the leg in the second motion state lands on the floor, and consequently to prevent the agent from losing balance due to the floor reaction force. Thereby, the burden by a caregiver for assisting the agent in walking motion to prevent such situation can be alleviated or eliminated.

In the walking motion assisting device of the first aspect, it is acceptable that the second state monitoring element is configured to recognize a first motion state in which the thigh of a leg is moved forward before or after the leg is transited from a leg standing state to a leg floating state or after the leg is transited from the leg standing state to the leg floating state as the leg motion state of the agent; and the second control command signal generating element is configured to generate the second control command signal for the second actuator when the leg of the agent has been recognized as being in the first motion state by the second state monitoring element so as to assist the relative motion between the thigh and the crus of the agent around the knee joint in the direction of bending the knee (Seventh aspect).

According to the walking motion assisting device having the aforementioned configuration, the relative motion between the thigh and the crus of the agent around the knee joint in the direction of bending the knee is assisted when a leg of the agent has been recognized as being in the first motion state (in which the thigh of the leg is moved forward before or after the leg is transited from a leg standing state to a leg floating state or after the leg is transited from the leg standing state to the leg floating state).

According thereto, it is possible to avoid the situation where it is difficult to continue the walking motion when the end portion of the leg is dragged on the floor due to the insufficient lifting amount of the end portion of the leg (for example, the foot) from the floor caused by insufficient bending of the knee while the thigh is shaken forward. Thereby, the burden by a caregiver for assisting the agent in walking motion to prevent such situation can be alleviated or eliminated.

In the walking motion assisting device of the seventh aspect, it is acceptable that the second control command signal generating element is configured to generate the second control command signal for the second actuator when the landing position of the leg calculated by the first state monitoring element is smaller than a lower limit of the specified range so as to increase the force generated when the leg of the agent is determined as being in the first motion state by the second state monitoring element for assisting the relative motion between the thigh and the crus of the agent around the knee joint in the direction of bending the knee stronger than the case when the landing position of the leg calculated by the first state monitoring element is equal to or greater than the lower limit of the specified range (Eighth aspect).

According to the walking motion assisting device having the aforementioned configuration, it is possible to avoid the situation where the end portion of the leg lands on the floor at an earlier time due to insufficient lifting amount of the end portion of the floating leg from the floor caused by insufficient bending of the knee of the floating leg being shaken ahead, and consequently to cause the landing position of the leg behind the specified range. Thereby, the burden by a caregiver for assisting the agent in walking motion to prevent such situation can be alleviated or eliminated.

In the walking motion assisting device of the seventh aspect, it is acceptable that the second state monitoring element is configured to recognize an intermediate motion state from the second motion state to the first motion state as the leg motion state of the agent; and the second control command signal generating element is configured to generate the second control command signal for the second actuator when the leg of the agent has been recognized as being in the intermediate motion state by the second state monitoring element so as to make zero the force for assisting the relative motion between the thigh and the crus of the agent around the knee joint (Ninth aspect).

According to the walking motion assisting device having the aforementioned configuration, the force for assisting the relative motion between the thigh and the crus of the agent around the knee joint knee is controlled to be equal to zero when the leg of the agent has been recognized as being in the intermediate motion state (transition state from the second motion state to the first motion state). According thereto, it is possible to avoid the situation where the walking motion of the agent becomes discontinuous or the balance is lost when the stretch or bending of the knee of the landing leg is hindered by the assisting force. Thereby, the burden by a caregiver for assisting the agent in walking motion to prevent such situation can be alleviated or eliminated.

In the walking motion assisting device of the seventh aspect, it is acceptable that the second state monitoring element is configured to recognize an intermediate motion state from the second motion state to the first motion state as the leg motion state of the agent; and the second control command signal generating element is configured to generate the second control command signal for the second actuator when the leg of the agent has been recognized as being in the intermediate motion state by the second state monitoring element so as to alter continuously or intermittently the force for assisting the relative motion between the thigh and the crus of the agent around the knee joint (Tenth aspect).

According to the walking motion assisting device having the aforementioned configuration, the force for assisting the relative motion between the thigh and the crus of the agent around the knee joint is controlled to alter continuously or intermittently when the leg of the agent has been recognized as being in the intermediate motion state. According thereto, it is possible to avoid the situation where the walking motion of the agent becomes discontinuous or the balance is lost due to the abrupt variation of the force for assisting the stretch or bending of the knee of the leg landing on the floor. Thereby, the burden by a caregiver for assisting the agent in walking motion to prevent such situation can be alleviated or eliminated.

It is acceptable that the walking motion assisting device of the first aspect further includes a treadmill, wherein the controller is provided with an intrinsic angular velocity setting element configured to set the second intrinsic angular velocity higher as a running speed of the treadmill detected by the first state monitoring element becomes faster when the agent is performing the walking motion on the treadmill (Eleventh aspect).

In the walking motion assisting device of the first aspect, it is acceptable that the first state monitoring element is configured to detect a walking speed or a walking period of the agent; and the controller is provided with an intrinsic angular velocity setting element configured to set the second intrinsic angular velocity higher as the walking speed of the agent detected by the first state monitoring element becomes faster or the walking period thereof detected by the first state monitoring element becomes shorter (Twelfth aspect).

According to the walking motion assisting device having the aforementioned configurations, the angular velocity of the second oscillator (first temporal differentiation value of the phase) and consequently the second intrinsic angular velocity, upon which the angular velocity of the assisting force from the first actuator is determined, can be set according to the walking speed or the walking period of the agent. Thereby, the walking motion of the agent can be assisted having the phase or the angular velocity of the walking motion of the agent in harmony with the phase or the angular velocity of the walking motion assisting device.

In the walking motion assisting device of the first aspect, it is acceptable that the motion oscillator detecting element is configured to detect an oscillation signal varying with time according to periodical motions of a leg of the agent as a first motion oscillator; and the controller is provided with a first oscillator generating element configured to generate a first oscillator as an output oscillation signal from a first model, which generates the output oscillation signal oscillating at a specific angular velocity defined on the basis of a first intrinsic angular velocity by entraining to an input oscillation signal, by mutually inputting the first motion oscillator determined by the motion oscillator detecting element as the input oscillation signal to the first model; and an intrinsic angular velocity setting element configured to set an angular velocity of a second virtual oscillator as the second intrinsic velocity according to a virtual model denoting a first virtual oscillator and a second virtual oscillator which oscillate at a second phase difference while interacting with each other on the basis of a first phase difference denoting a correlation between the phase polarity of the first motion oscillator detected by the motion oscillator detecting element and the phase polarity of the first oscillator generated by the first oscillator generating element so as to approximate the second phase difference to a desired phase difference (Thirteenth aspect).

According to the walking motion assisting device having the aforementioned configuration, the oscillation signal varying with time according to the leg motion of the agent is detected as the first motion oscillator. The first motion oscillator may be identical to or different from the second motion oscillator. By inputting the first motion oscillator into the first model, the first oscillator is generated. Thereby, the second intrinsic angular velocity, upon which the angular velocity of the assisting force from the first actuator is determined, can be defined on the basis of the phase difference between the first motion oscillator and the first oscillator (first phase difference).

Thereby, the walking motion of the agent can be assisted having the phase or the angular velocity of the walking motion of the agent in harmony with the phase or the angular velocity of the walking motion assisting device.

DETAILED DESCRIPTION OF THE PREFERRED EMBODIMENTS

An embodiment regarding a walking motion assisting device of the present invention will be described with reference to the drawings. Hereinafter, codes "L" and "R" are used to differentiate a left side and a right side of legs or the like. If it is not necessary to differentiate the left side and the right side or a vector has both of the left and right components, the codes are omitted. In addition, symbols "+" and "−" are used to differentiate a flexion motion (forward motion) and a stretch motion (backward motion) of a leg (in particular, a thigh).

(Configuration of Walking Motion Assisting Device)

Figure 1:
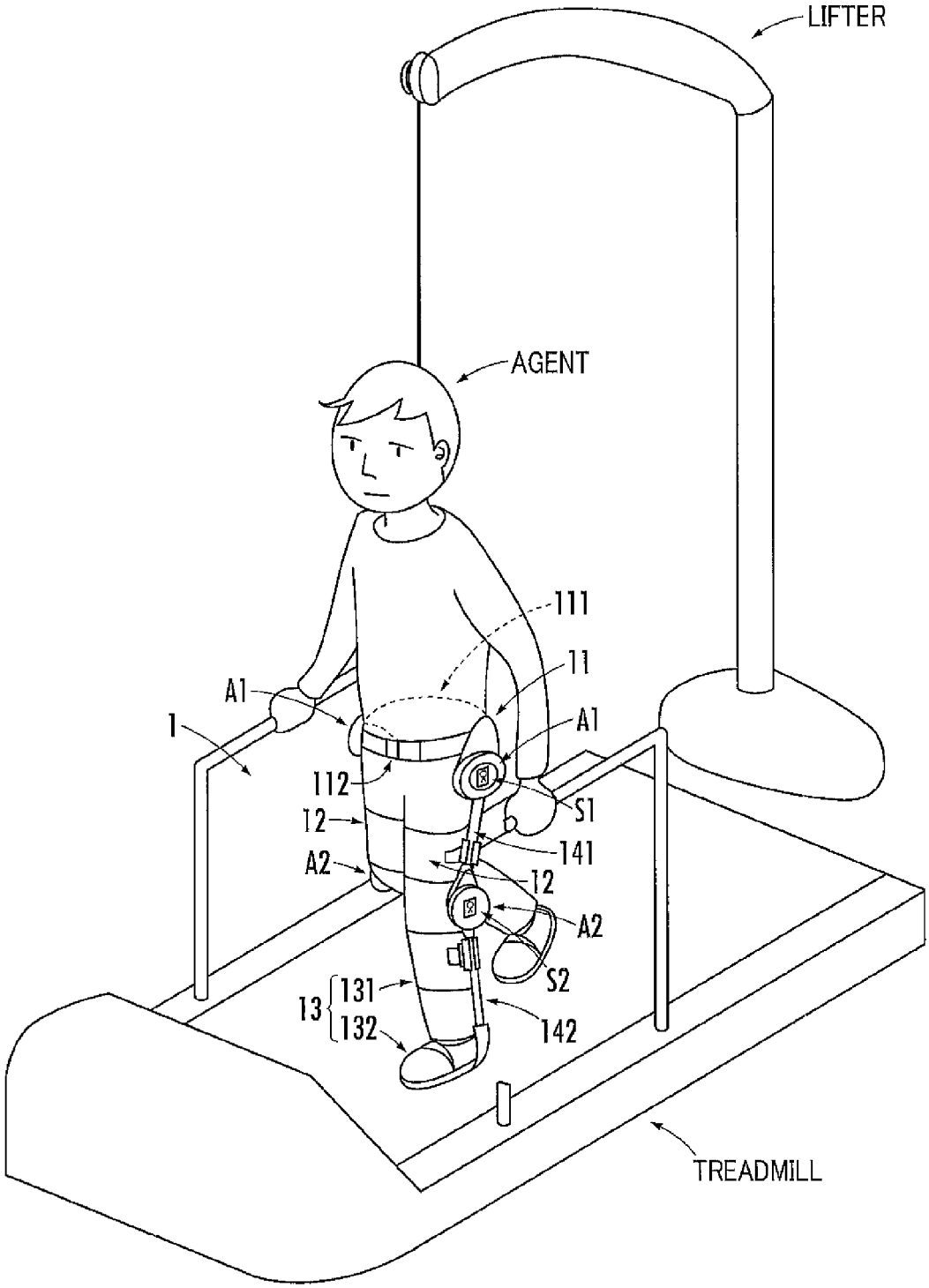
FIG. 1 is a structural view of a walking motion assisting device according to an embodiment of the present invention.
Figure 2:
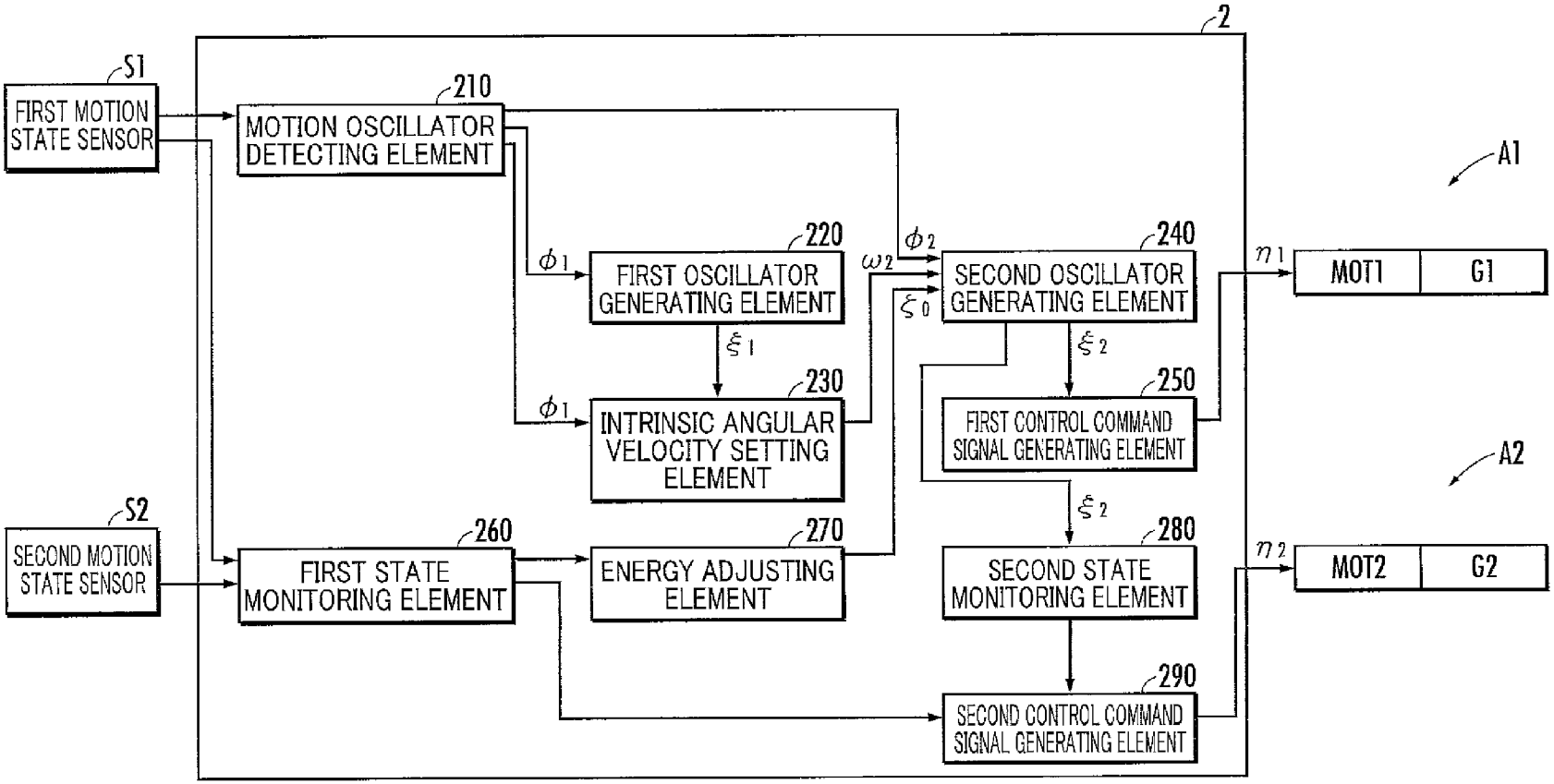
FIG. 2 is a block view illustrating a controller of the walking motion assisting device.

The walking motion assisting device 1 illustrated in FIG. 1 is provided with a first orthosis 11, a second orthosis 12, a third orthosis 13, a first actuator A1 and a second actuator A2. As illustrated in FIG. 2, the walking motion assisting device 1 is further provided with a first motion state sensor S1, a second motion state sensor S2 and a controller 2.

The first orthosis 11 is provided with a waist supporter 111 configured to support the waist of an agent (human being) from the backward and a band 112 configured to be wrapped around the abdomen for fixing the waist supporter around the waist. The waist supporter 111 is made from rigid resin having appropriate hardness and flexibility. A first base member made from metal is fixed on both lateral sides of the waist supporter 111, and the first actuator A1 is mounted on each of the first base members.

The second orthosis 12 is composed of a band configured to be wrapped around the thigh of the agent. A first link member 141 is attached to the second orthosis 12 for transmitting the output from the first actuator A1 to the second orthosis 12. The first link member 141 is made from hard resin and formed into a substantially rod shape. The first link member 141 is disposed outside of the thigh of the agent in the lateral direction. A lower end of the first link member 141 is fixed with a second base member made from metal, and the second actuator A2 is mounted on the second base member.

The third orthosis 13 is provided with a band 131 configured to be wrapped around the crus of the agent and a sandal 132 configured to be mounted to the foot. The sandal 132 is mounted to the foot through wrapping a band around the instep of the foot and a band around the ankle of the agent, respectively. A second link member 142 is attached to the band 131 and the sandal 132 for transmitting the output from the second actuator A2 to the band 131 and the sandal 132, respectively. The second link member 142 is made from hard resin and formed into a rod shape or a long and narrow plate shape. The second link member 142 is disposed outside of the thigh of the agent in the lateral direction.

It is acceptable that the second link member 142 is free to stretch or bend at a joint disposed in the middle. It is acceptable that at least a lower end of the second link member 142 is fixed to a plate supporting the bottom of the sandal 132 or integrated with the plate. The lower end may be made from metal. It is acceptable that the third orthosis 13 is provided with only the band 131 or the sandal 132.

The controller 2 is composed of a computer (having a CPU, a ROM, a RAM, an I/O circuit, an A/D conversion circuit and the like) housed in the waist supporter 111 of the first orthosis 11. The controller 2 is configured to perform an arithmetic process according to a software and data read out from an appropriate memory so as to control the motion of the first actuator A1 and the second actuator A2 on the basis of the output signals from the first motion state sensor S1 and the second motion state sensor S2, respectively.

The controller 2 is provided with a motion oscillator detecting element 210, a first oscillator generating element 220, an intrinsic angular velocity setting element 230, a second oscillator generating element 240, a first control command signal generating element 250, a first state monitoring element 260, an energy adjusting element 270, a second state monitoring element 280, and a second control command signal generating element 290. Each element is configured or programmed to perform the arithmetic process which will be described hereinafter. A part of or the entire part of each element may be composed of a common hardware resource.

The first actuator A1 is provided with a first motor MOT1 and a first reduction mechanism G1. The performance of the first motor MOT1 and the reduction rate of the first reduction mechanism G1 are controlled by the controller 2, respectively. An output from the first motor MOT1 after being reduced by the first reduction mechanism G1 corresponds to the output of the first actuator A1. The output of the first actuator A1 is transmitted to the waist of the agent via the first orthosis 11 and to the thigh of the agent via the first link member 141 and the second orthosis 12.

The second actuator A2 is provided with a second motor MOT2 and a second reduction mechanism G2. The performance of the second motor MOT2 and the reduction rate of the second reduction mechanism G2 are controlled by the controller 2, respectively. An output from the second motor MOT2 after being reduced by the second reduction mechanism G2 corresponds to the output of the second actuator A2. The output of the second actuator A2 is transmitted to the thigh of the agent via the second orthosis 12 and to the foot and the crus of the agent via the second link member 142 and the third orthosis 13.

The first motion state sensor S1 is disposed at each of both lateral sides of the agent's waist and is composed of a rotary encoder configured to output signals according to the hip joint angle $\theta_1$. The hip joint angle $\theta_1$ denotes a relative angle between the body and the thigh of the agent, and furthermore, an angle of the thigh with respect to the frontal plane (which divides the body of the agent into back and front portions, including the positions of right and left hip joints) (refer to FIG. 6A). The hip joint angle $\theta_1$ is defined as positive when the thigh is in front of the frontal plane and defined as negative when the thigh is behind the frontal plane. In addition, when a rotor angle of the first motor MOT1 constituting the first actuator A1 is used as a basis for calculating the leg angle, a hall element disposed in the first motor MOT1 which is configured to output signals according to the rotor angle may be adopted as the first motion state sensor S1.

The second motion state sensor S2 is disposed at each of both right and left lateral sides of the agent's knee joint and is composed of a rotary encoder configured to output signals according to the knee joint angle $\theta_2$. The knee joint angle $\theta_2$ denotes a relative angle between the waist and the thigh of the agent or a flexion angle of the knee joint (refer to FIG. 6A). In addition, when a rotor angle of the second motor MOT2 constituting the second actuator A2 is used as a basis for calculating the leg angle, a hall element disposed in the second motor MOT2 which is configured to output signals according to the rotor angle may be adopted as the second motion state sensor S2.

(Functions of the Walking Motion Assisting Device)

The description will be given on the method of assisting the agent in walking motion by the walking motion assisting device 1 having the aforementioned configuration. As illustrated in FIG. 1, the agent may have a walking motion on a treadmill. The body weight applied to the leg of the agent may be alleviated with the body of the agent lifted by a lifter or through holding handrails by the agent.

Figure 3:
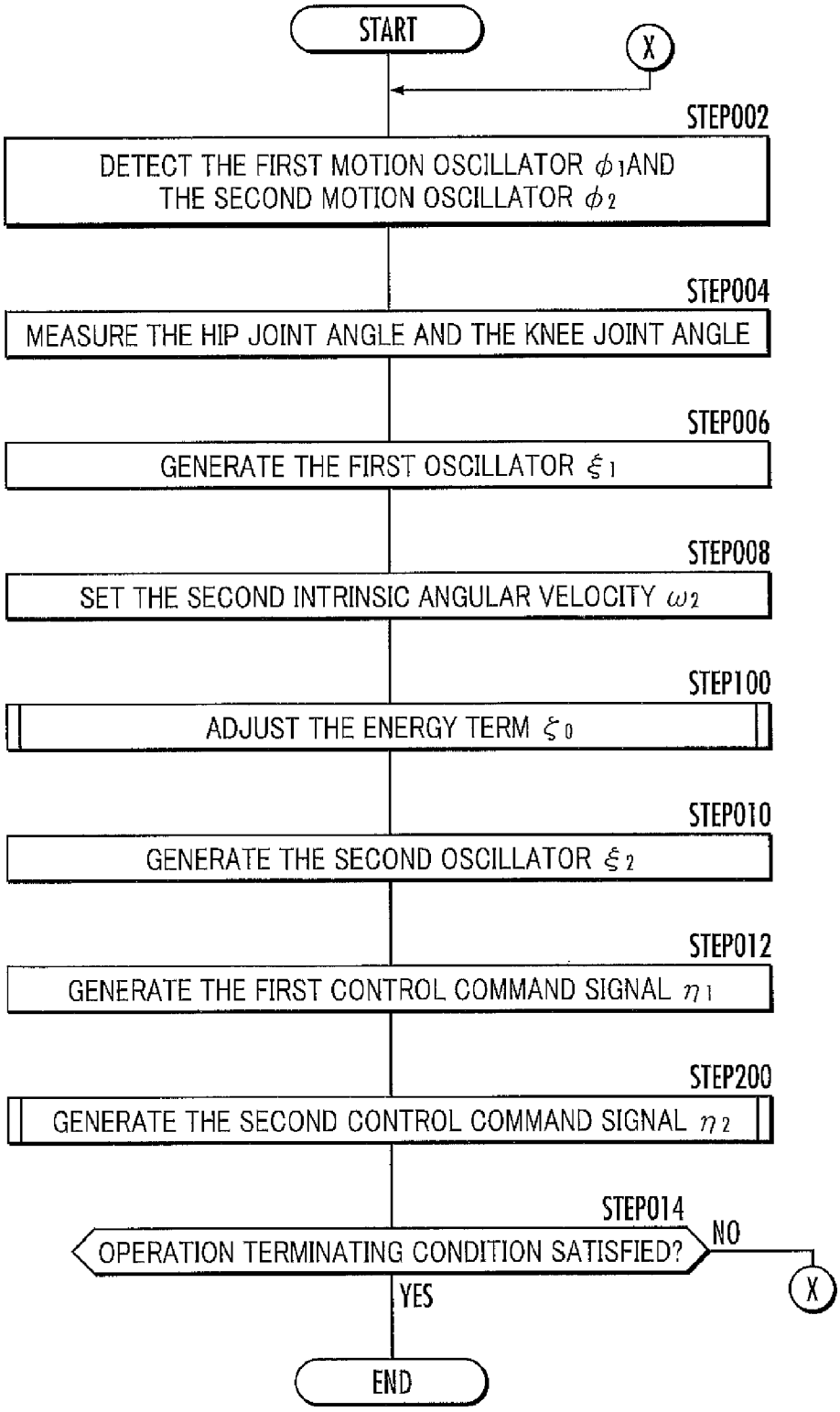
FIG. 3 is a flow chart illustrating a control process of the walking motion assisting device.

Firstly, on the basis of the output from the first motion state sensor S1, the motion state detecting element 210 detects the first motion oscillator $\phi_1$ and the second motion oscillator $\phi_2$ (FIG. 3/STEP 002). The first motion oscillator $\phi_1$ corresponds to the oscillation signals denoting an angular velocity variation mode of the right and left hip joints of the agent ($d\theta_{1L}/dt$, $d\theta_{1R}/dt$). The second motion oscillator $\phi_2$ corresponds to the oscillation signals denoting an angle variation mode of the right and left hip joints of the agent ($\theta_{1L}$, $\theta_{1R}$).

The motion state detecting element 210 receives the output signals from the first motion state sensor S1 every sampling period or every computation period and calculates the hip joint angle and the hip joint angular velocity which is a first order temporal differentiation of the hip joint angle for the agent.

The first motion oscillator $\phi_1$ and the second motion oscillator $\phi_2$ may be the same, such as both are equal to the hip joint angle or the hip joint angular velocity. It is acceptable that the first motion oscillator $\phi_1$ is the hip joint angle and the second motion oscillator $\phi_2$ is the hip joint angular velocity. It is acceptable that an arbitrary combination of the hip joint angle, the hip joint angular velocity, the knee joint angle, the knee joint angular velocity, the shoulder joint angle and the shoulder joint angular velocity at right and left sides of the agent is detected as the first motion oscillator $\phi_1$ and the second motion oscillator $\phi_2$. It is also acceptable that the floor reaction force applied to right and left legs of the agent is detected as the first motion oscillator $\phi_1$ and the second motion oscillator $\phi_2$.

The left hip joint angular velocity $d\theta_{1L}/dt$ and the right hip joint angular velocity $d\theta_{1R}/dt$, which are components of the 2 dimensional vector $\phi_1$, vary periodically in reversed phase according to periodical motions of the left thigh and the right thigh, which are 2 symmetrical body portions of the agent in the lateral direction, with respect to the waist respectively. Similarly, the left hip joint angle $\theta_{1L}$ and the right hip joint angle $\theta_{1R}$, which are components of the 2 dimensional vector $\phi_2$, vary periodically in approximately reversed phase according to periodical motions of the left thigh and the right thigh with respect to the waist respectively.

Figure 6:
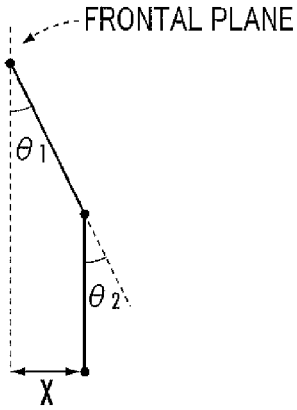
FIG. 6A to FIG. 6C are views related to calculation of a floor landing position.
Figure 6:
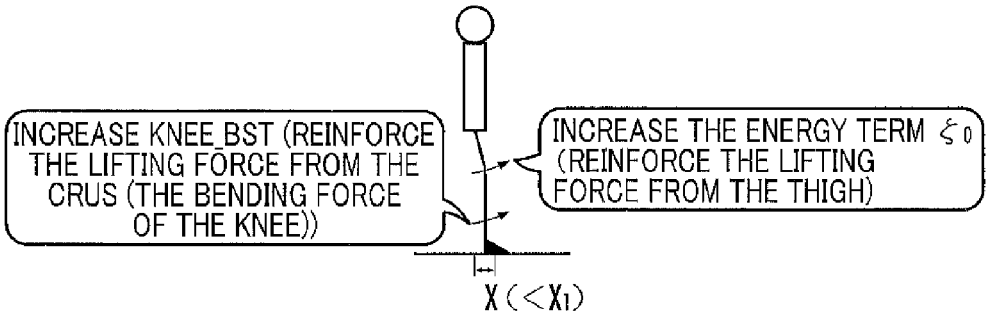
Figure 6:
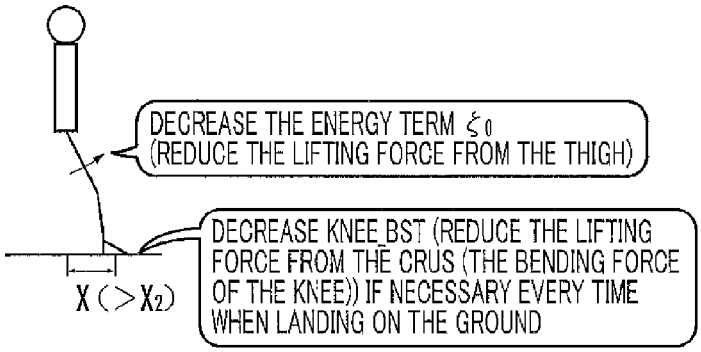

Thereafter, on the basis of the respective output from the first motion state sensor S1 and the second motion state sensor S2, the first state monitoring element 260 detects the hip joint angle $\theta_1=(\theta_{1L}, \theta_{1R})$ and the second motion oscillator $\theta_2=(\theta_{2L}, \theta_{2R})$ (refer to FIG. 3/STEP 004 and FIG. 6A).

Subsequently, the first oscillator generating element 220 generates the first oscillator $\xi_1=(\xi_{1L}, \xi_{1R})$ by inputting the first motion oscillator $\phi_1$ detected by the motion oscillator detecting element 210 into a first model (FIG. 3/STEP 006).

The first model generates an output oscillation signal oscillating at a specific angular velocity defined on the basis of a first intrinsic angular velocity $\omega_1=(\omega_{1L}, \omega_{1R})$ by mutually entraining to an input oscillation signal. The first model is expressed by Van der Pol equation (010).

$$(d^2\xi_{1L}/dt^2)=\chi(1-\xi_{1L}^2)(d\xi_{1L}dt)-\omega_{1L}^2\xi_{1L}+g(\xi_{1L}-\xi_{1R})+K_{1\phi 1L},$$

$$(d^2\xi_{1R}/dt^2)=\chi(1-\xi_{1R}^2)(d\xi_{1R}dt)-\omega_{1R}^2\xi_{1R}+g(\xi_{1R}-\xi_{1L})+K_{1\phi 1R} \quad (010)$$

Wherein, $\chi$: a positive coefficient set in such a way that a stable limit cycle is be drawn from the first oscillator $\xi_1$ and the first order temporal differentiation value ($d\xi_1/dt$) thereof in a plane of "$\xi_1-(d\xi_1/dt)$"; g: a first correlation coefficient for reflecting the correlation of the right and left legs in the first model; and $K_1$: a feedback coefficient. The first intrinsic angular velocity $\omega_1$ can be set arbitrarily in a range deviated not far away from the angular velocity for determining the phase variation mode of the motions of the walking motion assisting device 1.

The first oscillator $\xi_1=(\xi_{1L}, \xi_{1R})$ is calculated according to the Runge-Kutta method. The first oscillator $\xi_1$ has the property to oscillate periodically with an angular velocity defined on the basis of the first intrinsic angular velocity $\omega_1$ while harmonizing with an angular velocity of the first motion oscillator $\phi_1$ varying with time at a period substantially the same as the motion period of the agent according to the "mutual entrainment" which is one of the properties of the Van del Pol equation.

In addition to Van der Pol equation (010), the first model may be expressed by an arbitrary equation which generates an output oscillation signal varying with time at an angular velocity in harmony with an angular velocity of the first motion oscillator $\phi_1$ through the mutual entrainment to the first motion oscillator $\phi_1$ serving as an input oscillation signal.

According to the first model, even the first motion oscillator $\phi_1$ substantially does not vary with time when the motions of the legs of the agent have stopped, it is possible to generate the first oscillator $\xi_1$ oscillating or with the phase varying at the angular velocity determined according to the first intrinsic angular velocity $\omega_1$.

Then, the intrinsic angular velocity setting element 230 sets a second intrinsic angular velocity $\omega_2$ on the basis of the first motion oscillator $\phi_1$ detected by the motion oscillator detecting element 210 and the first oscillator $\xi_1$ generated by the first oscillator generating element 220 (FIG. 3/STEP 008). The set value of the second intrinsic angular velocity in the current time is used as the first intrinsic angular velocity $\omega_1$ of the first oscillator $\xi_1$ in the next time (refer to the equation (010)).

In detail, for each of the left and right components, the first phase difference $\delta\theta_1$ denoting the correlation between the phase polarity of the first motion oscillator $\phi_1$ and the phase polarity of the first oscillator $\xi_1$ is obtained according to the relational expression (021).

$$\delta\theta_1=\int dt\cdot\delta\theta(\phi_1,\xi_1),$$

$$\delta\theta(\phi_1,\xi_1)\equiv\mathrm{sgn}(\xi_1)\{\mathrm{sgn}(\phi_1)-\mathrm{sgn}(d\xi_1/dt)\},$$

$$\mathrm{sgn}(\theta)\equiv-1(\theta<0),\ 0(\theta=0)\ \text{or}\ 1(\theta>0) \tag{021}$$

The second phase difference $\delta\theta_2$ is obtained according to a virtual model on a condition that the first phase difference $\delta\theta_1$ is constant over previous 3 walking periods. According to the virtual model, the correlation between a virtual motion oscillator $\theta_h$ and a virtual auxiliary oscillator $\theta_m$ is denoted by the relational expressions (022) and (023). The second phase difference $\delta\theta_2$ is obtained from the relational expression (024).

$$(d\theta_h/dt)=\omega_h-\epsilon\sin(\theta_m-\theta_h) \tag{022}$$

$$(d\theta_m/dt)=\omega_m-\epsilon\sin(\theta_h-\theta_m) \tag{023}$$

$$\delta\theta_2=\arcsin[(\omega_h-\omega_m)/2\epsilon] \tag{024}$$

Wherein, $\epsilon$: correlation coefficient of the virtual motion oscillator $\theta_h$ and the virtual auxiliary oscillator $\theta_m$; $\omega_h$: angular velocity of the virtual motion oscillator $\theta_h$; and $\omega_m$: angular velocity of the virtual motion oscillator $\theta_m$.

Subsequently, the correlation coefficient $\epsilon$ is set in order to minimize the difference ($\delta\theta_1-\delta\theta_2$) between the first phase difference $\delta\theta_1$ and the second phase difference $\delta\theta_2$. In detail, for each of the right and left components, the correlation coefficient $\epsilon$ at the time $\{t_i|\ i=1, 2, \ldots\}$ when $\phi_1=0$ and $d\phi_1/dt>0$ is set sequentially according to the relational expression (025).

$$\epsilon(t_{i+1})=\epsilon(t_i)-\eta\{V(t_{i+1})-V(t_i)\}/\{\epsilon(t_i)-\epsilon(t_{i-1})\},$$

$$V(t_{i+1})\equiv(1/2)\{\delta\theta_1(t_{i+1})-\delta\theta_2(t_i)\}^2 \tag{025}$$

Wherein, $\eta=(\eta_L, \eta_R)$ stands for a coefficient denoting the stability of a potential $V=(V_{1L}, V_{1R})$ for approximating each of the right and left components of the first phase difference $\delta\theta_1$ to each of the right and left components of the second phase difference $\delta\theta_2$, respectively.

In order to minimize the difference ($\delta\theta_1-\delta\theta_2$) between the first phase difference $\delta\theta_1$ and the second phase difference $\delta\theta_2$ for each of the right and left components, under the condition that the angular velocity $\omega_m$ of the virtual auxiliary oscillator $\theta_m$ is constant, the angular velocity $\omega_h$ of the virtual motion oscillator $\theta_h$ is calculated on the basis of the correlation coefficient $\epsilon$ by using the coefficient $\alpha=(\alpha_L, \alpha_R)$ denoting the system stability according to the relational expression (026).

$$\omega_h(t_i)=-\alpha\int dt\cdot([4\epsilon(t_i)^2-\{\omega_h(t)-\omega_m(t_i)\}^2]^{1/2}\times\sin[\arcsin\{(\omega_h(t)-\omega_m(t_{i-1}))/2\epsilon(t_i)\}-\delta\theta_1(t_i)]) \tag{026}$$

Subsequently, for each of the right and left components, the angular velocity $\omega_m$ of the virtual auxiliary oscillator $\theta_m$ is set as the second intrinsic angular velocity $\omega_2$ on the basis of the angular motion oscillator $\theta_h$. Specifically, in order to approximate the second phase difference $\delta\theta_2$ to the desired phase difference $\delta\theta_0$ for each of the right and left components, the angular velocity $\omega_m=(\omega_{mL}, \omega_{mR})$ of the virtual auxiliary oscillator $\theta_m$ is set according to the relational expression (027) by using the coefficient $\beta=(\beta_L, \beta_R)$ denoting the system stability.

$$\omega_m(t_i)=\beta\int dt\cdot([4\epsilon(t_i)^2-\{\omega_h(t_i)-\omega_m(t)\}^2])\times\sin[\arcsin\{\omega_h(t_i)-\omega_m(t))/2\epsilon(t_i)\}-\delta\theta_0]) \tag{027}$$

Thereafter, the energy adjusting element 270 adjusts the value of the persistent energy input term $\zeta_0$ (FIG. 3/STEP 100). The persistent energy input term $\zeta_0$ and the adjusting method of its value will be described hereinafter.

Subsequently, on the basis of the second motion oscillator $\phi_2$ detected by the motion oscillator detecting element 210, the second intrinsic angular velocity $\omega_2$ set by the intrinsic angular velocity setting element 230, and the persistent energy input term $\zeta_0$ set by the energy adjusting element 270, the second oscillator generating element 240 generates the second oscillator $\xi_2=(\xi_{2L+}, \xi_{2L-}, \xi_{2R+}, \xi_{2R-})$ according to the second model (FIG. 3/STEP 010).

The second model is defined by a simultaneous differential equation of plural state variables denoting a motion state of the agent, and generates, on the basis of an input oscillation signal, the output oscillation signal varying with time according to an amplitude corresponding to a value of the persistent energy input term $\zeta_0$ included in the simultaneous differential equation and the angular velocity determined based on the second intrinsic angular velocity $\omega_2$.

The second model is defined by a simultaneous differentiation equation represented by, for example, the equation (030).

$$\tau_{1L+}(du_{L+}/dt)=c_{L+}\zeta_{0L+}-u_{L+}+w_{L+/L-}\xi_{2L-}+w_{L+/R+}\xi_{2R+}-\lambda_L v_{L+}+f_1(\omega_{2L})+f_2(\omega_{2L})K_{2\phi 2L},$$

$$\tau_{1L-}(du_{L-}/dt)=c_{L-}\zeta_{0L-}-u_{L-}+w_{L-/L+}\xi_{2L+}+w_{L-/R-}\xi_{2R-}-\lambda_L v_{L-}+f_1(\omega_{2L})+f_2(\omega_{2L})K_{2\phi 2L},$$

$$\tau_{1R+}(du_{R+}/dt)=c_{R+}\zeta_{0R+}-u_{R+}+w_{R+/L+}\xi_{2L+}+w_{R+/R-}\xi_{2R+}-\lambda_R v_{R+}+f_1(\omega_{2R})+f_2(\omega_{2R})K_{2\phi 2R},$$

$$\tau_{1R-}(du_{R-}/dt)=c_{R-}\zeta_{0R-}-u_{R-}+w_{R-/L-}\xi_{2L-}+w_{R-/R+}\xi_{2R+}-\lambda_R v_{R-}+f_1(\omega_{2R})+f_2(\omega_{2R})K_{2\phi 2R},$$

$$\tau_{2i}(dv_i/dt)=-v_{2i}+\xi_{2i}(i=L+,L-,R+,R-),$$

$$\xi_{2i}=H(u_i-u_{th})=0(u_i<u_{th}) \text{ or } u_i(u_i\geq u_{th}), \text{ or}$$

$$\xi_{2i}=fs(u_i)=u_i/(1+\exp(-u_i/D)) \quad (030)$$

The simultaneous differentiation equation (030) contains therein a state variable $u_i$ denoting the behavior state (specified by amplitude and phase) to each of the flexion direction (forward direction) and the stretch direction (backward direction) of each thigh, and a self-inhibition factor $v_i$ denoting adaptability of each behavior state. Moreover, the simultaneous differentiation equation (030) contains therein a coefficient $c_i$ related to the persistent energy input term $\zeta_0$.

"$\tau_{1i}$" is a first time constant for defining the variation feature of the state variable $u_i$. $\tau_{1i}$ is represented by the relational expression (031) using a ω-dependant coefficient $t_{(\omega 2)}$ and a constant $\gamma=(\gamma_L, \gamma_R)$ and varies dependent on the second intrinsic angular velocity $\omega_2$.

$$\tau_{1L+}=\tau_{1L-}=(t(\omega_{2L})/(\omega_{2L})/-\gamma_L, \tau_{1R+}=\tau_{1R-}=(t(\omega_{2R})/\omega_{2R})-\gamma_R \quad (031)$$

"$\tau_{2i}$" is a second time constant for defining the variation feature of the self-inhibition factor $v_1$. "$w_{i/j}$" is a negative second correlation coefficient denoting the correlation between the state variables $u_i$ and $u_j$ denoting the motions of the right and left legs of the agent toward the flexion direction and the stretch direction as the correlation of each component of the second oscillator $\xi_2$. "$\lambda_L$" and "$\lambda_R$" are compliant coefficients. "$\kappa_2$" is a feedback coefficient related to the second motion oscillator $\phi_2$.

"$f_1$" is a linear function of the second intrinsic angular velocity $\omega_2$ defined according to the relational expression (032) using the positive coefficient c. "$f_2$" is a quadratic function of the second intrinsic angular velocity $\omega_2$ defined according to the relational expression (033) using the coefficients $c_0$, $c_1$ and $c_2$.

$$f_1(\omega_2)\equiv c\omega_2 \quad (032)$$

$$f_2(\omega_2)\equiv c_0\omega_2+c_1\omega_2+c_2\omega_2^2 \quad (033)$$

The second oscillator $\xi_{2i}$ equals to zero when the value of the state variable $u_i$ is smaller than a threshold value $u_{th}$; and equals to the value of $u_i$ when the value of the state variable $u_i$ is not smaller than the threshold value $u_{th}$. In other words, the second oscillator $\xi_{2i}$ is defined by a sigmoid function fs (refer to the equation (030)). According thereto, if the state variable $u_{L+}$ denoting the behavior of the left thigh toward the forward direction increases, the amplitude of the left flexion component $\xi_{2L+}$ of the second oscillator $\xi_2$ becomes greater than that of the left stretch component $\xi_{2L-}$; if the state variable $u_{R+}$ denoting the behavior of the right thigh toward the forward direction increases, the amplitude of the right flexion component $\xi_{2R+}$ of the second oscillator $\xi_2$ becomes greater than that of the right stretch component $\xi_{2R-}$.

Further, if the state variable $u_{L-}$ denoting the behavior of the left thigh toward the backward direction increases, the amplitude of the left stretch component $\xi_{2L-}$ of the second oscillator $\xi_2$ becomes greater than that of the left flexion component $\xi_{2L+}$; if the state variable $u_{R-}$ denoting the behavior of the right thigh toward the backward direction increases, the amplitude of the right stretch component $\xi_{2R-}$ of the second oscillator $\xi_2$ becomes greater than that of the right flexion component $\xi_{2R+}$. The motion of the leg (thigh) toward the forward or backward direction is recognized by, for example, the polarity of the hip joint angular velocity.

Thereafter, on the basis of the second oscillator $\xi_2$, the first control command signal generating element 250 generates a first control command signal $\eta_1=(\eta_{1L}, \eta_{1R})$ according to, for example, the relational expression (040) (FIG. 3/STEP 012).

$$\eta_{1L}=\chi_{L+}\xi_{2L+}-\chi_{L-}\xi_{2L-}, \eta_{1R}=\chi_{R+}\xi_{2R+}-\chi_{R-}\xi_{2R-} \quad (040)$$

The left component $\eta_{1L}$ of the first control command signal $\eta_1$ is calculated as a sum between a product of the left flexion component $\xi_{2L+}$ of the second oscillator $\xi_2$ and the coefficient $\chi_{L+}$ and a product of the left stretch component $\xi_{2L-}$ of the second oscillator $\xi_2$ and the coefficient "$-\chi_{L-}$". The right component $\eta_{1R}$ of the first control command signal $\eta_1$ is calculated as a sum between a product of the right flexion component $\xi_{2R+}$ of the second oscillator $\xi_2$ and the coefficient $\chi_{R+}$ and a product of the right stretch component $\xi_{2R-}$ of the second oscillator $\xi_2$ and the coefficient "$-\chi_{R-}$".

Thereafter, a current $I_1=(I_{1L}, I_{1R})$ supplied to each of the first actuators A1 disposed at the right and the left sides respectively from the battery is adjusted by the controller 2 on the basis of the first control command signal $\eta_1$. As a result, the torque $tq_1=(tq_{1L}, tq_{1R})$ for assisting the relative motions between the waist (the first body part) and the thigh (the second body part) around the hip joint via the first orthosis 11 and the second orthosis 12 is adjusted. The torque $tq_1$ is denoted by, for example, $tq_1=G_1\cdot I_1(t)$ (wherein, $G_1$ is a ratio coefficient) on the basis of the current $I_1$.

As to be described hereinafter, the second control command signal generating element 290 generates a second control command signal (FIG. 3/STEP 200).

Thus, a current $I_2=(I_{2L}, I_{2R})$ supplied to each of the second actuators A2 disposed at the right and the left sides respectively from the battery is adjusted by the controller 2 on the basis of the second control command signal $\eta_2$. As a result, the torque $tq_2=(tq_{2L}, tq_{2R})$ for assisting the relative motions between the thigh (the second body part) and the crus (the third body part) around the knee joint via the second orthosis 12 and the third orthosis 13 is adjusted. The torque $tq_2$ is denoted by, for example, $tq_2=G_2\cdot I_2(t)$ (wherein, $G_2$ is a ratio coefficient) on the basis of the current $I_2$.

Thereafter, whether or not operation termination conditions such as an operation switch is switched from ON to OFF, an abnormal motion is detected and the like are satisfied is determined (FIG. 3/STEP 014). If the determination result is negative (FIG. 3/STEP 014 . . . NO), the series of the aforementioned processes are performed repeatedly. On the other hand, if the determination result is positive (FIG. 3/STEP 014 . . . YES), the series of the aforementioned processes are terminated.

(Adjusting Method of the Value of the Persistent Energy Input Term)

Descriptions will be given on the adjusting method of the value of the persistent energy input term $\zeta_0$ contained in the simultaneous differentiation equation (030) denoting the second model (refer to FIG. 3/STEP 100). When the operation is initiated (at the time when the operation switch is switched from OFF to ON), the persistent energy input term $\zeta_0$ is set at the initial value of "0".

Figure 4:
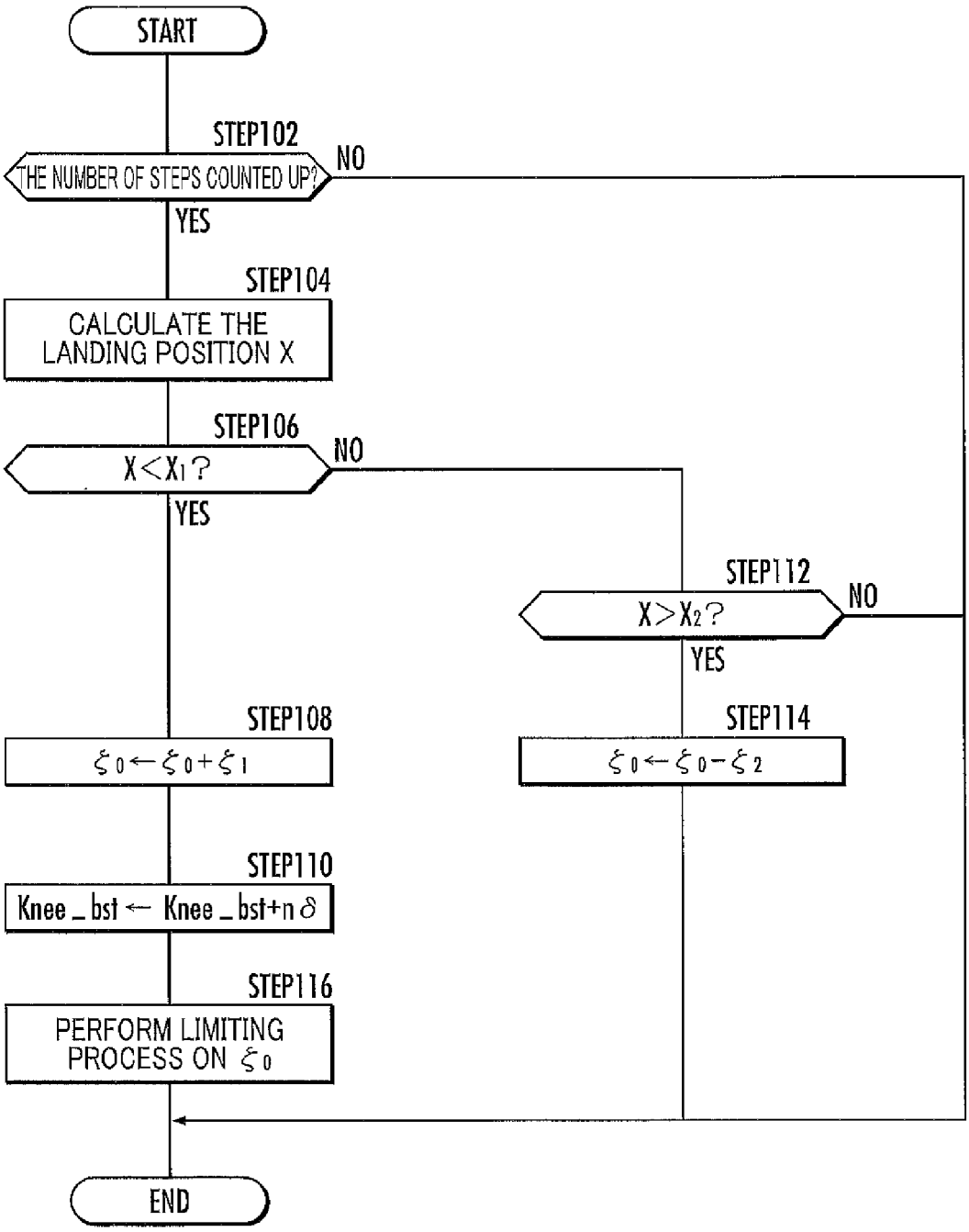
FIG. 4 is a flow chart related to the adjusting the value of a persistent energy input term.

Firstly, the first state monitoring element 260 determines whether or not the step of the agent has been counted up (FIG. 4/STEP 102). The count up of a step means that the transition of either leg of the agent from the leg floating state to the leg standing state has been made.

The step is counted up according to a sensor signal indicating that the agent has landed the floating leg (leg floated from a walking floor) on the floor, for example, the left hip joint angular velocity $d\theta_{1L}/dt$ or the right hip joint angular velocity $d\theta_{1R}/dt$ of the agent has been shifted from increasing to decreasing at the flexion side (front side), the level of output signals from the pressure sensor disposed at the sole has surpassed the threshold value, the vertical acceleration component applied to the agent denoted by the output signals from an acceleration sensor disposed at the waist or the like has been shifted over the threshold value, and the like.

When it is determined that the step of the agent has been counted up, in other words, one leg in the floating state has been landed on the floor (FIG. 4/STEP 102 . . . YES), the first state monitoring element 260 calculates the landing position x with relation to the frontal plane of the leg (FIG. 4/STEP 104).

The landing position x is calculated on the basis of the determined values of the hip joint angle $\theta_1$ and the knee joint angle $\theta_2$, the thigh length $L_1$ and the crus length $L_2$ of the agent according to the geometrical equation (100) (refer to FIG. 6A). The thigh length $L_1$ and the crus length $L_2$ of the agent are input through an interface such as an operation panel into the controller 2 and stored in memory.

$$x=L_1 \sin \theta_1+L_2 \sin(\theta_1-\theta_2) \quad (100)$$

Thereafter, whether or not the landing position x of the agent is smaller than the lower limit $x_1$ of a specified range is determined by the energy adjusting element 270 (FIG. 4/STEP 106). When it is determined that the landing position x of the agent is smaller than the lower limit $x_1$ of the specified range (FIG. 4/STEP 106 . . . YES), the energy adjusting element 270 sets the value of the persistent energy input term $\zeta_0$ with an increment of $\zeta_1$ (>0) for the leg to transit from the leg floating state to the leg standing state until next time (FIG. 4/STEP 108). As illustrated schematically in FIG. 6B, when the stepped distance of the leg toward the front side is not sufficient, the shaking amplitude of the thigh toward the front side is increased so as to compensate the insufficient amount.

Moreover, the second control command signal generating element 290 sets the coefficient knee_bst for specifying the strength of the force for assisting the motion of the leg to transit from the leg floating state to the leg standing state around the knee joint until next time with an increment of nδ (n: natural number; δ>0) (FIG. 4/STEP 110). As illustrated schematically in FIG. 6B, when the stepped distance of the leg toward the front side is not sufficient, the lifted amount of the crus is increased by increasing the flexion of the knee joint so as to compensate the insufficient amount.

On the other hand, when it is determined that the landing position x of the agent is not smaller than the lower limit $x_1$ of the specified range (FIG. 4/STEP 106 . . . NO), whether or not the landing position x of the agent is greater than the upper limit $x_2$ of the specified range is determined by the energy adjusting element 270 (FIG. 4/STEP 112).

When it is determined that the landing position x of the agent is greater than the upper limit $x_2$ of the specified range (FIG. 4/STEP 112 . . . YES), the energy adjusting element 270 sets the value of the persistent energy input term $\zeta_0$ with a decrement of $\zeta_2$ (>0) for the leg to transit from the leg floating state to the leg standing state next time (FIG. 4/STEP 114). As illustrated schematically in FIG. 6B, when the stepped distance of the leg toward the front side is excessive, the shaking amplitude of the thigh toward the front side is decreased so as to compensate the excessive amount.

Subsequently, the energy adjusting element 270 performs a limiting process on the updated persistent energy input term $\zeta_0$ (FIG. 4/STEP 116). Specifically, when the persistent energy input term $\zeta_0$ is smaller than the lower limit of an allowable range, the persistent energy input term $\zeta_0$ is compensated to fall within the allowable range, such as equal to the lower limit. When the persistent energy input term $\zeta_0$ is greater than the upper limit of the allowable range, the persistent energy input term $\zeta_0$ is compensated to fall within the specified range, such as equal to the upper limit. When the persistent energy input term $\zeta_0$ falls within the allowable range, the persistent energy input term $\zeta_0$ is maintained unchanged.

When it is determined that the step of the agent has not been counted up (FIG. 4/STEP 102 . . . NO), or the landing position x falls within the specified range $[x_1, x_2]$ (FIG. 4/STEP 106 . . . NO and FIG. 4/STEP 112 . . . NO), the persistent energy input term $\zeta_0$ is maintained unchanged.

(Generation Method of the Second Control Command Signal)

Descriptions will be given on the generation method of the second control command signal $\eta_2$ for the second actuator A2 (refer to FIG. 3/STEP 200).

Figure 5:
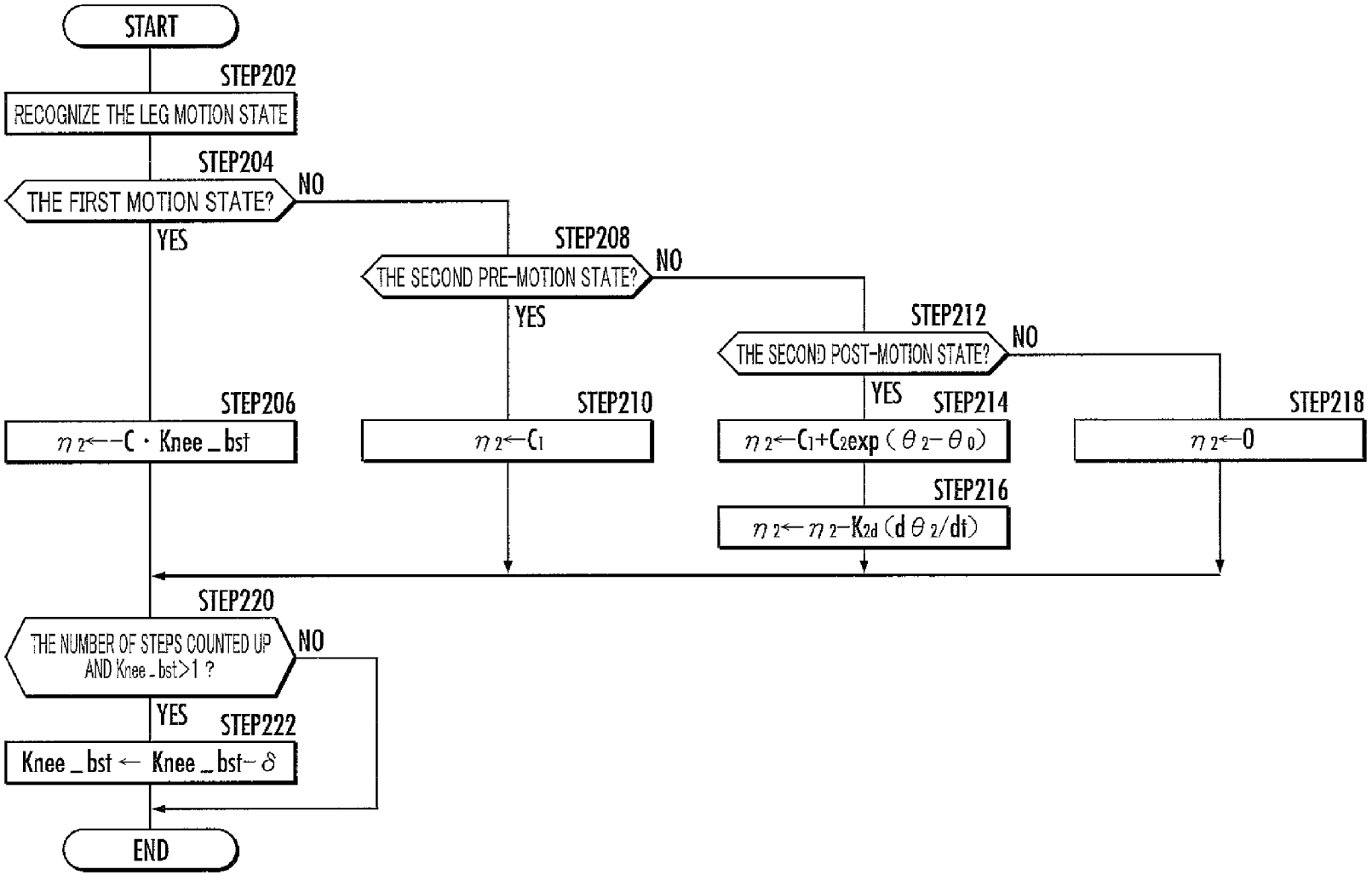
FIG. 5 is a flow chart related to the determination of motion states and generation of control command signals.

Firstly, the motion state of a leg of the agent is recognized by the second state monitoring element 280 on the basis of the variation mode of the second oscillator $\xi_2$ (FIG. 5/STEP 202).

The recognition basis will be briefly explained. The second intrinsic angular velocity $\omega_2$ for specifying the period of the second oscillator $\xi_2$ is set to approximate the phase difference $\delta\theta_1$ between the first motion oscillator $\phi_1$ and the first oscillator $\xi_1$ to the desired phase difference $\delta\theta_0$ (FIG. 3/STEP 008).

Therefore, the period of the second oscillator $\xi_2$ is substantially equal to the period of the first motion oscillator $\phi_1$, and eventually the walking motion period of the agent. Moreover, the phase difference between the first motion oscillator $\phi_1$ and the second oscillator $\xi_2$ is maintained substantially constant (for example, the desired phase difference $\delta\theta_0$). Thereby, the phase of the first motion oscillator $\phi_1$ denoting the motion state of the agent can be estimated from the phase of the second oscillator $\xi_2$. The recognition basis is explained as the above.

It is acceptable that the motion state of a leg of the agent is recognized on the basis of the variation mode of the first motion oscillator $\phi_1$ (the hip joint angular velocity) or the second motion oscillator $\phi_2$ (the hip joint angle) in place of the variation mode of the second oscillator $\xi_2$.

Figure 7:
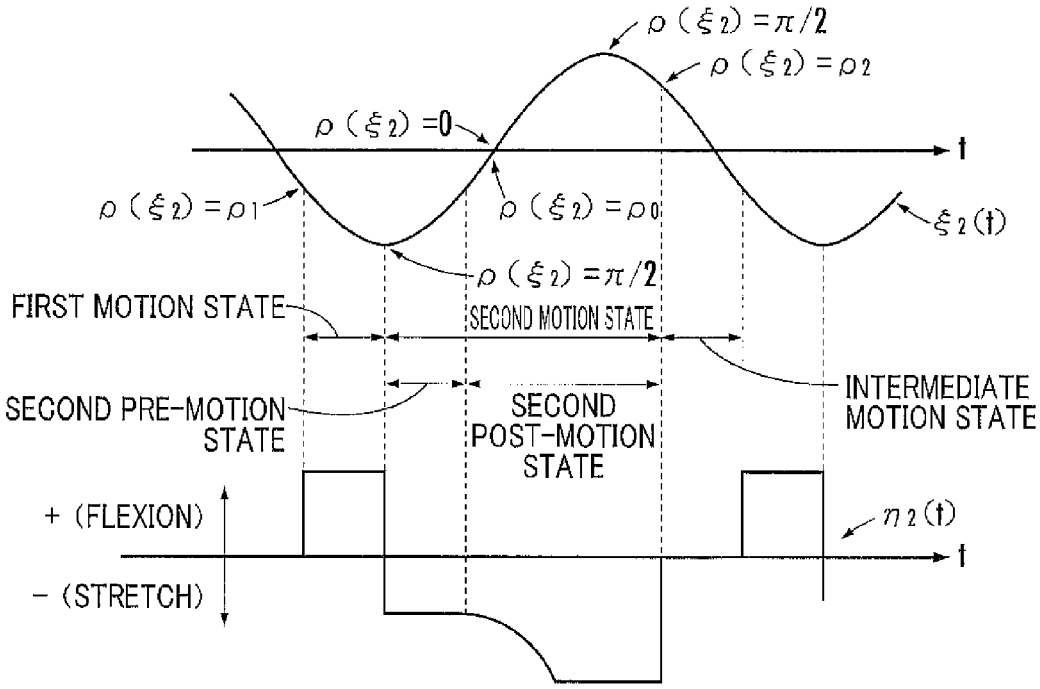
FIG. 7A and FIG. 7B are views related to the determination of motion states and generation of control command signals.
Figure 7:
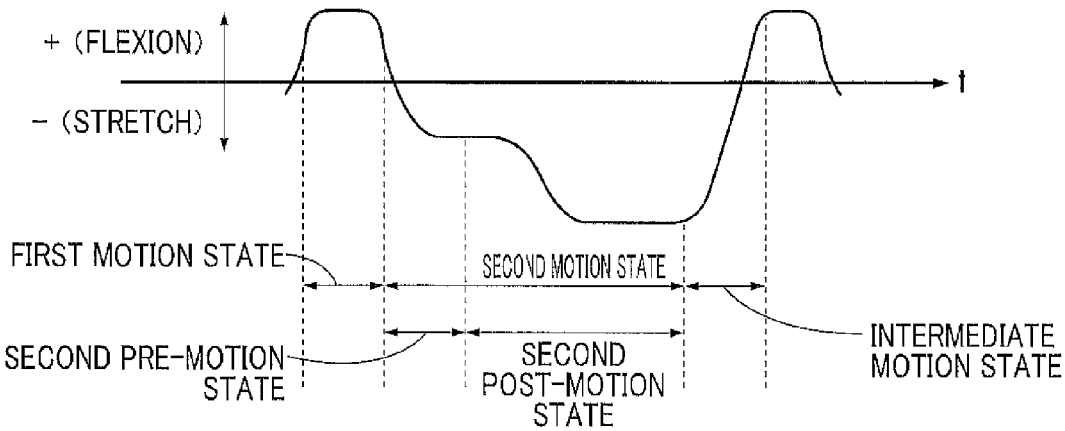

When the second oscillator $\xi_2$ oscillates or has phase varied as illustrated in the upper section of FIG. 7A, the phase of the second oscillator $\xi_1$ and the phase of the hip joint angle $\theta_1$ are assumed identical. The first motion state, the second motion state and the intermediate motion state are recognized separately as the motion state of a leg of the agent.

When the phase $\rho(\xi_2)$ of the second oscillator $\xi_2$ is within a duration decreasing from the first reference angle $\rho_1$ ($-\pi/2<\rho_1<0$) to $-\pi/2$, the motion state of the leg of the agent is recognized as the first motion state. This duration corresponds to the duration when the hip joint angle $\theta_1$ varies from a negative value (the leg standing state or the thigh of the leg transited from the leg standing state to the leg floating state is being positioned slightly behind the frontal plane) to the local minimal value (the thigh is completely shaken to the backward). The first motion state means the motion state where the thigh of a leg is moved forward before or after the leg is transited from the leg standing state to the leg floating state or after the leg is transited from the leg standing state to the leg floating state (refer to FIGS. 8C and 8D).

When the phase $\rho(\xi_2)$ of the second oscillator $\xi_2$ is within a duration increasing from $-\pi/2$ to $\pi/2$ and then decreasing from $\pi/2$ to the second reference angle $\rho_2$ ($0<\rho_2<\pi/2$), the motion state of the leg of the agent is recognized as the second motion state. This duration corresponds to the duration when the hip joint angle $\theta_1$ varies from the local minimal value (the thigh is completely shaken to the backward) through the local maximum value (the thigh is completely shaken to the forward) to a value slightly decreased from the local maximum value (the thigh is slightly moved to the backward from the state when the thigh is completely shaken to the forward). The second motion state means that the thigh of a leg is moved backward in a post-phase of the leg floating state and the leg standing state of the leg (refer to FIGS. 8E and 8F).

Further, a second pre-motion state and a second post-motion state are recognized separately as the motion state of the leg of the agent.

When the phase $\rho(\xi_2)$ of the second oscillator $\xi_2$ is within a duration increasing from $-\pi/2$ to the intermediate reference angle $\rho_0$ ($-\pi/2<\rho_0<0$), the motion state of the leg of the agent is recognized as the second pre-motion state. The second pre-motion state means the state where the leg is behind the frontal plane in the second motion state (refer to FIG. 8C).

When the phase $\rho(\xi_2)$ of the second oscillator $\xi_2$ is within a duration increasing from the intermediate reference angle $\rho_0$ to $\pi/2$ and then decreasing from $\pi/2$ to the second reference angle $\rho_2$, the motion state of the leg of the agent is recognized as the second post-motion state. The second post-motion state means the state where the leg is ahead of the frontal plane in the second motion state (refer to FIG. 8D).

When the phase $\rho(\xi_2)$ of the second oscillator $\xi_2$ is within a duration increasing from the second reference angle $\rho_2$ to the first reference angle $\rho_1$, the motion state of the leg of the agent is recognized as an intermediate motion state. This duration corresponds to the duration when the hip joint angle $\theta_1$ is slightly decreased from the local maximum value (the thigh is slightly moved to the backward from the state when the thigh is completely shaken to the forward) to the negative value (the leg standing state or the thigh of the leg transited from the leg standing state to the leg floating state is being positioned behind the frontal plane). The intermediate motion state means the state where the leg is transited from the second motion state to the first motion state (refer to FIGS. 8A and 8B).

When the leg of the agent has been recognized as being in the first motion state (FIG. 5/STEP 204 . . . YES), the second control command signal generating element 290 sets the second control command signal $\eta_2$ for the leg to transit from the leg floating state to the leg standing state next time to $-C\cdot$knee_bst ($C>0$, knee_bst>0) (FIG. 5/STEP 206). The knee_bst is a coefficient set greater than normal when the landing position x of the agent is smaller than the lower limit of the specified range (refer to FIG. 4/STEP 106 . . . YES and STEP 110).

When the leg of the agent has been recognized as being in the second pre-motion state (FIG. 5/STEP 204 . . . NO, STEP 208 . . . YES), the second control command signal generating element 290 sets the second control command signal $\eta_2$ for the leg to transit from the leg floating state to the leg standing state next time to $C_1$ ($C_1>0$) (FIG. 5/STEP 210).

When the leg of the agent has been recognized as being in the second post-motion state (FIG. 5/STEP 208 . . . NO, STEP 212 . . . YES), the second control command signal generating element 290 sets the second control command signal $\eta_2$ for the leg to transit from the leg floating state to the leg standing state next time to $C_1+C_2\exp(\theta_2-\theta_0)(C_2>0)$ (FIG. 5/STEP 214).

Thereafter, the second control command signal generating element 290 adds a dumper term "$-k_{2d}(d\theta_2/dt)$" according to the knee joint angular velocity ($d\theta_2/dt$) to the second control command signal $\eta_2$ (FIG. 5/STEP 216). Moreover, the first control command signal generating element 250 adds a dumper term "$-k_{1d}(d\theta_1/dt)$" according to the hip joint angular velocity ($d\theta_1/dt$) to the first control command signal $\eta_1$.

When the leg of the agent has been recognized as being in the intermediate motion state (FIG. 5/STEP 212 . . . NO), the second control command signal generating element 290 sets the second control command signal 112 for the leg to transit from the leg floating state to the leg standing state next time to 0 (FIG. 5/STEP 218).

As mentioned in the above, by setting the second control command signal $\eta_2$ according to the motion state of the leg, the second actuator A2 can be controlled according to the second control command signal $\eta_2$ varying as illustrated in the lower section of FIG. 7A. It is acceptable to generate the second control command signal $\eta_2$ varying not discontinuously as illustrated in the lower section of FIG. 7A but varying continuously as illustrated in FIG. 7B.

The second state monitoring element 280 determines whether or not the step has been counted up and the knee_bst at the time where the step is counted up has been greater than 1 (normalized threshold) (FIG. 5/STEP 220).

When the determination result is positive (FIG. 5/STEP 220 . . . YES), the second control command signal generating element 290 sets the coefficient knee_bst to transit from the leg floating state to the leg standing state next time with a decrement of $\delta$ (FIG. 5/STEP 222). As illustrated schematically in FIG. 6C, when the stepped distance of the leg toward the front side is excessive, the lifted amount of the crus is decreased by decreasing the flexion of the knee joint so as to compensate the excessive amount.

On the other hand, when the determination result is negative (FIG. 5/STEP 220 . . . NO), the coefficient knee_bst is maintained unchanged.

(Effects of the Walking Motion Assisting Device)

According to the walking motion assisting device 1 fulfilling the aforementioned function, the oscillation signal varying with time according to the motions of a leg of the agent is detected as the first motion oscillator $\phi_1$ (refer to FIG. 3/STEP 002). BY inputting the first motion oscillator $\phi_1$ into the first model, the first oscillator $\xi_1$ is generated (refer to FIG. 3/STEP 006). Thereby, the second intrinsic angular velocity $\omega_2$, upon which the angular velocity of the motion assisting force $tq_1$ (first phase difference) from the first actuator A1 is determined, can be defined on the basis of the phase difference $\delta\theta_1$ between the first motion oscillator $\phi_1$ and the first oscillator $\xi_1$ (refer to FIG. 3/STEP 008).

Moreover, the oscillation signal varying with time according to the motions of a leg of the agent is detected as the second motion oscillator $\phi_2$ (refer to FIG. 3/STEP 002). By inputting the second motion oscillator $\phi_2$ into the second model, the second oscillator $\xi_2$ is generated (refer to FIG. 3/STEP 010). On the basis of the second oscillator $\xi_2$, the first control command signal $\eta_1$ is generated, and the first actuator A1 is controlled on the basis of the first control command signal $\eta_1$ (refer to FIG. 3/STEP 012)

According thereto, the force $tq_1$ for assisting the leg motion of the agent can be controlled with the motion period or the phase variation velocity of the leg of the agent in harmony with the motion period or the phase variation velocity of the first actuator A1.

The value of the persistent energy input term $\zeta_0$ contained in the simultaneous differential equation (030) denoting the second model is adjusted so as to limit the landing position x of the leg with respect to the frontal plane of the agent (the foot position of the leg when the leg transits from the leg floating state to the leg standing state) in the specified range $[x_1, x_2]$ (refer to FIG. 4/STEP 108 and STEP 114).

According thereto, the assisting force $tq_1$ from the first actuator A1 is adjusted. For example, when the previous time's landing position of the leg is behind the specified range, the value of the persistent energy input term $\zeta_0$ is increased to reinforce the force $tq_1$ for assisting the thigh motion so as to make the current time's landing position of the leg forward than the previous time's landing position (refer to FIG. 4/STEP 108 and FIG. 6B). On the other hand, when the previous time's landing position of the leg is in front of the specified range, the value of the persistent energy input term $\zeta_0$ is decreased to weaken the force $tq_1$ for assisting the thigh motion so as to make the current time's landing position of the leg behind the previous time's landing position (refer to FIG. 4/STEP 114 and FIG. 6C). Thereby, the burden by a caregiver for assisting the thigh of the agent in walking motion can be alleviated or eliminated.

When the leg landing position x is smaller than the lower limit $x_1$ of the specified range, the value of the persist energy input term $\zeta_0$ is increased greater than the case when the leg landing position x is equal to or greater than the lower limit $x_1$ (FIG. 4/STEP 106 . . . YES to STEP 108).

Accordingly, the assisting force tq2 from the second actuator A2 is reinforced (refer to FIG. 6B). Therefore, it is possible to avoid the situation where the end portion of the leg lands on the floor at an earlier time due to insufficient lifting amount of the end portion of the floating leg from the floor caused by insufficient bending of the knee of the floating leg being shaken ahead, and consequently to cause the landing position x of the leg behind the specified range. Thereby, the burden by a caregiver for assisting the agent in walking motion to prevent such situation can be alleviated or eliminated.

Further, the motion state of the leg is recognized on the basis of the variation mode of the second motion oscillator $\phi_2$ or the second oscillator $\xi_2$ (refer to FIG. 5/STEP 202 and FIG. 7A). On the basis of the recognition result, the relative motion between the thigh and crus of the leg around the knee joint is assisted (refer to FIG. 5/STEP 206, STEP 210, STEP 214, STEP 216, and FIG. 7A).

Specifically, the relative motion between the thigh and the crus of the agent around the knee joint in the direction of bending the knee is assisted when a leg of the agent has been recognized as being in the first motion state (in which the thigh of the leg is moved forward before or after the leg is transited from a leg standing state to a leg floating state or after the leg is transited from the leg standing state to the leg floating state) (refer to FIG. 5/STEP 206, FIG. 7A, FIG. 7B, FIG. 8A, and FIG. 8B).

According thereto, it is possible to avoid the situation where it is difficult to continue the walking motion when the end portion of the leg is dragged on the floor due to the insufficient lifting amount of the end portion of the leg (for example, the foot) from the floor caused by insufficient bending of the knee while the thigh is shaken forward. Thereby, the burden by a caregiver for assisting the agent in walking motion to prevent such situation can be alleviated or eliminated.

When the leg of the agent has been recognized as being in the second post-motion state (in which the leg is behind the frontal plane in the second motion state), the force $tq_2$ for assisting the relative motion between the thigh and the crus of the leg around the knee joint in the direction of stretching the knee is increased stronger than the case when the leg of the agent has been recognized as being in the second pre-motion state (in which the leg is in the second motion state and the thigh is ahead of the frontal plane) (refer to FIG. 5/STEP 210, STEP 214, FIG. 7A, FIG. 7B, FIG. 8C, and FIG. 8D).

Figure 8:
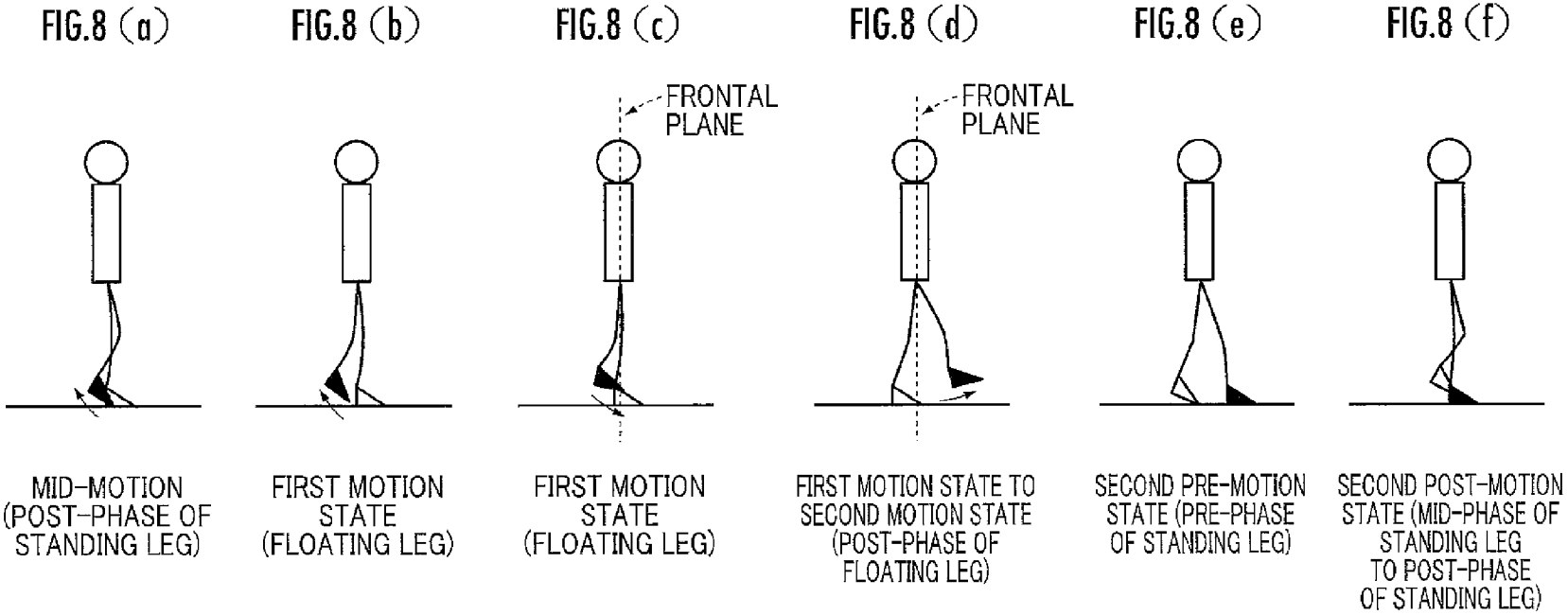
FIG. 8A to FIG. 8F are views related to the motion states of an agent.

According thereto, it is possible to avoid the situation where a leg is difficult to step on the floor or the balance of the agent's body is lost when the leg steps on the floor due to insufficient stretch of the knee even though the thigh has been shaken ahead of the frontal plane (refer to FIG. 8D and FIG. 8E). Thereby, the burden by a caregiver for assisting the agent in walking motion to prevent such situation can be alleviated or eliminated.

The second control command signal $\eta_2$ is generated to increase continuously or intermittently the force for assisting the relative motion between the thigh and the crus of the agent around the knee joint in the direction of stretching the knee in the initial phase of the second post-motion state (refer to the duration illustrated in FIG. 7A where the phase $\rho(\xi)$ is increasing from the intermediate reference value $\rho_0$). According thereto, it is possible to avoid the situation where the force for assisting knee to stretch when the leg is shaken ahead of the frontal plane varies abruptly, and consequently, the motion of the leg of the agent becomes discontinuously due to the abrupt force variation, which makes it difficult for the agent to land the leg on the floor or makes the agent lose the balance of the body when landing the leg on the floor.

When the leg of the agent has been recognized as being in the intermediate motion state (transition state from the second motion state to the first motion state), the force $tq_2$ for assisting the motion of the leg around the knee joint is controlled to be equal to zero (refer to FIG. 5/STEP 218, FIG. 7A, FIG. 8E and FIG. 8F). According thereto, it is possible to avoid the situation where the walking motion of the agent becomes discontinuous or the balance is lost when the stretch or bending of the knee of the standing leg is hindered by the assisting force. Thereby, the burden by a caregiver for assisting the agent in walking motion to prevent such situation can be alleviated or eliminated.

When the leg of the agent has been recognized as being in the intermediate motion state (transition state from the second motion state to the first motion state), the force $tq_2$ for assisting the motion of the leg around the knee joint is controlled to alter continuously or intermittently (refer to FIG. 5/STEP 218, FIG. 7B, FIG. 8E and FIG. 8F). Thus, it is possible to control the force $tq_2$ for assisting the motion of the leg around the knee joint to alter continuously or intermittently when the leg of the agent has been recognized as being in the intermediate motion state. According thereto, it is possible to avoid the situation where the walking motion of the agent becomes discontinuous or the balance is lost due to the abrupt variation of the force for assisting the stretch or bending of the knee of the leg landing on the floor. Thereby, the burden by a caregiver for assisting the agent in walking motion to prevent such situation can be alleviated or eliminated.

When the leg of the agent has been recognized by the second state monitoring element 280 as being in the second motions state (the second post-motion state), the dumper term $-k_{1d}(d\theta_1/dt)$ is added to the first control command signal $\eta_1$ according to the hip joint angular velocity ($d\theta_1/dt$) by the first control command signal generating element 250 (refer to FIG. 5/STEP 212 . . . YES).

Accordingly, the assisting force $tq_1$ from the first actuator A1 is attenuated according to the angular velocity ($d\theta_1/dt$) of the hip joint at least in the final phase of the second motion state. According thereto, the floor reaction force can be prevented from becoming excessively stronger when the leg in the second motion state lands on the floor (refer to FIG. 8E), and consequently to prevent the agent from losing balance due to the floor reaction force. Thereby, the burden by a caregiver for assisting the agent in walking motion to prevent such situation can be alleviated or eliminated.

When the leg of the agent has been recognized by the second state monitoring element 280 as being in the second motions state (the second post-motion state), the dumper term $-k_{2d}(d\theta_2/dt)$ is added to the second control command signal $\eta_2$ according to the knee joint angular velocity ($d\theta_2/dt$) by the second control command signal generating element 290 (refer to FIG. 5/STEP 212 . . . YES and STEP 216).

Accordingly, the force $tq_2$ from the second actuator A2 is attenuated according to the angular velocity ($d\theta_2/dt$) of the knee joint at least in the initial phase of the second motion state (particularly when the leg is still in the leg floating state, refer to FIG. 8D). According thereto, the floor reaction force can be prevented from becoming excessively stronger when the leg in the second motion state lands on the floor (refer to FIG. 8E), and consequently to prevent the agent from losing balance due to the floor reaction force. Thereby, the burden by a caregiver for assisting the agent in walking motion to prevent such situation can be alleviated or eliminated.

Another Embodiment of the Present Invention

It is acceptable to assist the walking motion of an agent which is an animal other than a human being, such as an ape, a dog, a horse, a cow or the like.

The second oscillator $\xi_2$ may be generated by setting the second intrinsic angular velocity $\omega_2$ according to the running speed of the treadmill (moving speed of the endless belt contacted by the leg of the agent), the hip joint angular velocity, the walking speed, or the walking period with the detection of the first motion oscillator $\phi_1$ (refer to FIG. 3/STEP 102) and the generation of the first oscillator $\xi_1$ (refer to FIG. 3/STEP 104) omitted. The treadmill may be a constituent element of the walking motion assisting device.

The second motion state (in which the thigh of a leg is moved forward when the leg is transited from the leg floating state to the leg standing state) may be recognized as the motion state of the leg of the agent without differentiating the second pre-motion state and the second post-motion state. According to the recognition result, the relative motion between the thigh and the crus around the knee joint in the direction of stretching the knee can be assisted (refer to FIGS. 7A and 7B).

According thereto, it is possible to avoid the situation where it is difficult for the leg to step on the floor or the balance of the body of the agent is lost when the leg steps on the floor due to insufficient stretch of the knee even though the thigh has been shaken forward. Thereby, the burden by a caregiver for assisting the agent in walking motion to prevent such situation can be alleviated or eliminated.

The second oscillator $\xi_2$ may be generated by setting the second intrinsic angular velocity $\omega_2$ according to the hip joint angular velocity, the walking speed, or the walking period with the detection of the first motion oscillator $\phi_1$ (refer to FIG. 3/STEP 002) and the generation of the first oscillator $\xi_1$ (refer to FIG. 3/STEP 006) omitted.

Specifically, it is acceptable that the first state monitoring element 260 is configured to detect the walking speed or the walking period of the agent; and the intrinsic angular velocity setting element 230 is configured to set the second intrinsic angular velocity $\omega_2$ higher as the walking speed of the agent becomes faster or the walking period thereof becomes shorter.

The walking speed of the agent can be obtained by dividing the sum or the average value of footsteps in one step or over plural steps by the sum or the average value of periods of the hip joint angular velocity $\theta_1$. It is also acceptable to measure the belt moving speed of the treadmill with a speedometer disposed in the treadmill and use the belt moving speed as the walking speed of the agent.

The walking period of the agent is calculated as the average value of the periods of the hip joint angular velocity $\theta_1$. It is also acceptable to detect a variation period of vertical components of a pressure applied to the belt of the treadmill with a pressure gauge disposed in the treadmill and use the variation period as the walking period of the agent.

The angular velocity of the second oscillator $\xi_2$ (first temporal differentiation value of the phase) and consequently the second intrinsic angular velocity $\omega_2$, upon which the angular velocity of the motion assisting force $tq_1$ from the first actuator A1 is determined, can be set according to the walking speed or the walking period of the agent. Thereby, the walking motion of the agent can be assisted having the phase or the angular velocity of the walking motion of the agent in harmony with the phase or the angular velocity of the walking motion assisting device.

Similar to the first control command signal $\eta_1$, the second control command signal $\eta_2$ may be generated on the basis of the second oscillator $\xi_2$ generated as aforementioned. The second oscillator $\xi_2$ serving as the basis of the second control command signal $\eta_2$ may be identical to or different from the second oscillator $\xi_2$ serving as the basis of the first control command signal $\eta_1$. The second oscillator $\xi_2$ serving as the basis of the second control command signal $\eta_2$ may be generated from the second model on the basis of the knee joint angular velocity ($d\theta_2/dt$) or the knee joint angle $\theta_2$ serving as the second motion oscillator $\phi_2$.

What is claimed is:

1. A walking motion assisting device comprising:

a first orthosis adapted to be mounted on a body of an agent;

a second orthosis adapted to be mounted on a thigh of the agent;

a third orthosis adapted to be mounted on a crus of the agent;

a first actuator;

a second actuator; and a controller configured to control an amplitude and a phase of an output from the first actuator and an amplitude and a phase of an output from the second actuator, respectively, the walking motion assisting device being configured to assist walking motion of the agent by assisting a relative motion between the body and the thigh of the agent around a hip joint through an intermediary of the first orthosis and the second orthosis according to the output from the first actuator and a relative motion between the thigh and the crus of the agent around a knee joint through an intermediary of the second orthosis and the third orthosis according to the output from the second actuator;

wherein the controller is provided with a motion oscillator detecting element configured to detect an oscillation signal varying with time according to periodical motions of a leg of the agent, the detected oscillation signal being a second motion oscillator;

a second oscillator generating element configured to generate, as a first output oscillation signal, a second oscillator from a second model, which is defined by a simultaneous differential equation of state variables denoting a motion state of the agent and generates the first output oscillation signal varying with time at a specific angular velocity defined on the basis of a second intrinsic angular velocity and an amplitude corresponding to a value of a persistent energy input term included in the simultaneous differential equation according to a first input oscillation signal, by inputting the second motion oscillator determined by the motion oscillator detecting element as the first input oscillation signal to the second model;

a first control command signal generating element configured to generate a first control command signal for the first actuator according to the second oscillator generated by the second oscillator generating element;

a first state monitoring element configured to calculate a landing position of a leg with respect to a frontal plane on the basis of a determined hip joint angle, a determined knee joint angle, the thigh length and the crus length of the agent according to a geometrical relationship;

an energy adjusting element configured to adjust the value of the persistent energy input term so as to limit the landing position of the leg calculated by the first state monitoring element in a specified range;

a second state monitoring element configured to recognize a motion state of a leg of the agent according to a variation mode of the second motion oscillator detected by the motion oscillator detecting element or a variation mode of the second oscillator generated by the second oscillator generating element; and a second control command signal generating element configured to generate a second control command signal for the second actuator according to a leg motion state of the agent recognized by the second state monitoring element to assist the relative motion between the thigh and the crus of the agent around the knee joint in different modes.

2. The walking motion assisting device according to claim 1, wherein the second state monitoring element is configured to recognize a second motion state in which the thigh of a leg is moved backward in a post-phase of a leg floating state and a leg standing state of the leg as the leg motion state of the agent; and the second control command signal generating element is configured to generate the second control command signal for the second actuator when the leg of the agent has been recognized as being in the second motion state by the second state monitoring element so as to assist the relative motion between the thigh and the crus of the agent around the knee joint in the direction of stretching the knee.

3. The walking motion assisting device according to claim 2, wherein the second state monitoring element is configured to recognize separately a second pre-motion state in which the thigh is ahead of the frontal plane and a second post-motion state in which the thigh is behind the frontal plane as the second motion state; and the second control command signal generating element is configured to generate the second control command signal for the second actuator when the leg of the agent has been recognized as being in the second post-motion state by the second state monitoring element so as to assist the relative motion between the thigh and the crus of the agent around the knee joint in the direction of stretching the knee with a stronger force than the case when the leg of the agent has been recognized as being in the second pre-motion state by the second state monitoring element.

4. The walking motion assisting device according to claim 3, wherein the second control command signal generating element is configured to generate the second control command signal for the second actuator when the leg of the agent has been recognized as being in the second post-motion state by the second state monitoring element so as to increase continuously or intermittently the force for assisting the relative motion between the thigh and the crus of the agent around the knee joint in the direction of stretching the knee at least in an initial phase of the second post-motion state.

5. The walking motion assisting device according to claim 2, wherein the first control command signal generating element is configured to generate the first control command signal for the first actuator when the leg of the agent has been recognized as being in the second motion state by the second state monitoring element so as to decrease the force for assisting the relative motion between the body and the thigh of the agent around the hip joint according to an angular velocity of the hip joint at least in an initial phase of the second motion state.

6. The walking motion assisting device according to claim 2, wherein the second control command signal generating element is configured to generate the second control command signal for the second actuator when the leg of the agent has been recognized as being in the second motion state by the second state monitoring element so as to decrease the force for assisting the relative motion between the thigh and the crus of the agent around the knee joint in the direction of stretching the knee according to an angular velocity of the knee joint at least in an initial phase of the second motion state.

7. The walking motion assisting device according to claim 1, wherein the second state monitoring element is configured to recognize a first motion state in which the thigh of a leg is moved forward before or after the leg is transited from a leg standing state to a leg floating state or after the leg is transited from the leg standing state to the leg floating state as the leg motion state of the agent; and the second control command signal generating element is configured to generate the second control command signal for the second actuator when the leg of the agent has been recognized as being in the first motion state by the second state monitoring element so as to assist the relative motion between the thigh and the crus of the agent around the knee joint in the direction of bending the knee.

8. The walking motion assisting device according to claim 7, wherein the second control command signal generating element is configured to generate the second control command signal for the second actuator when the landing position of the leg calculated by the first state monitoring element is smaller than a lower limit of a specified range so as to increase the force generated when the leg of the agent is determined as being in the first motion state by the second state monitoring element for assisting the relative motion between the thigh and the crus of the agent around the knee joint in the direction of bending the knee stronger than the case when the landing position of the leg calculated by the first state monitoring element is equal to or greater than the lower limit of the specified range.

9. The walking motion assisting device according to claim 7, wherein the second state monitoring element is configured to recognize an intermediate motion state from the second motion state to the first motion state as the leg motion state of the agent; and the second control command signal generating element is configured to generate the second control command signal for the second actuator when the leg of the agent has been recognized as being in the intermediate motion state by the second state monitoring element so as to make zero the force for assisting the relative motion between the thigh and the crus of the agent around the knee joint.

10. The walking motion assisting device according to claim 7, wherein the second state monitoring element is configured to recognize an intermediate motion state from the second motion state to the first motion state as the leg motion state of the agent; and the second control command signal generating element is configured to generate the second control command signal for the second actuator when the leg of the agent has been recognized as being in the intermediate motion state by the second state monitoring element so as to alter continuously or intermittently the force for assisting the relative motion between the thigh and the crus of the agent around the knee joint.

11. The walking motion assisting device according to claim 1 further including a treadmill, wherein the controller is provided with an intrinsic angular velocity setting element configured to set the second intrinsic angular velocity higher as a running speed of the treadmill detected by the first state monitoring element becomes faster when the agent is performing the walking motion on the treadmill.

12. The walking motion assisting device according to claim 1, wherein the first state monitoring element is configured to detect a walking speed or a walking period of the agent; and the controller is provided with an intrinsic angular velocity setting element configured to set the second intrinsic angular velocity higher as the walking speed of the agent detected by the first state monitoring element becomes faster or the walking period thereof detected by the first state monitoring element becomes shorter.

13. The walking motion assisting device according to claim 1, wherein the motion oscillator detecting element comprises an element configured to detect an oscillation signal varying with time according to periodical motions of a leg of the agent as a first motion oscillator; and the controller is provided with a first oscillator generating element configured to generate, as a second output oscillation signal, a first oscillator from a first model, which is defined as to generate the second output oscillation signal oscillating at a specific angular velocity defined on the basis of a first intrinsic angular velocity by mutually entraining to a second input oscillation signal, by inputting the first motion oscillator determined by the motion oscillator detecting element as the second input oscillation signal to the first model; and an intrinsic angular velocity setting element configured to set an angular velocity of a second virtual oscillator as a second intrinsic velocity according to a virtual model denoting a first virtual oscillator and a second virtual oscillator which oscillate at a second phase difference while interacting with each other on the basis of a first phase difference denoting a correlation between a phase polarity of the first motion oscillator detected by the motion oscillator detecting element and a phase polarity of the first oscillator generated by the first oscillator generating element so as to approximate the second phase difference to a desired phase difference.

* * * * *